US008221049B1

(12) United States Patent
Westendorf et al.

(10) Patent No.: US 8,221,049 B1
(45) **Date of Patent: *Jul. 17, 2012**

(54) INDEPENDENT HYDRAULIC PINCHING FINGERS WITH DETACHABLE SECONDARY IMPLEMENT

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 310 days.

This patent is subject to a terminal disclaimer.

(21) Appl. No.: 12/510,068

(22) Filed: Jul. 27, 2009

Related U.S. Application Data

(63) Continuation-in-part of application No. 11/222,642, filed on Sep. 9, 2005, now Pat. No. 7,566,197.

(51) Int. Cl.
*B66C 1/00* (2006.01)

(52) U.S. Cl. ..... 414/729; 294/106

(58) Field of Classification Search ..... 414/729, 414/735, 739, 403, 724; 294/86.4, 87.1, 294/88, 104, 106, 107; 37/403, 406, 405, 37/903

See application file for complete search history.

(56) References Cited

U.S. PATENT DOCUMENTS

| | | | | | |
|---|---|---|---|---|---|
| 2,326,338 | A | | 8/1943 | Drott | 37/409 |
| 2,812,595 | A | | 11/1957 | Houghton | 37/409 |
| 3,077,999 | A | | 2/1963 | James | 37/409 |
| 3,243,905 | A | | 4/1966 | Ulrich | 37/406 |
| 3,342,357 | A | * | 9/1967 | Larson | 414/731 |
| 3,344,540 | A | | 10/1967 | Ulrich | 37/406 |
| 3,422,975 | A | | 1/1969 | Crisp | 414/732 |
| 3,452,888 | A | | 7/1969 | Larson | 414/552 |
| 3,455,477 | A | | 7/1969 | Blair | 414/704 |
| 3,512,665 | A | | 5/1970 | Westendorf | 414/723 |
| 4,030,625 | A | | 6/1977 | Koehnen | 414/739 |
| RE29,805 | E | | 10/1978 | Koehnen | 414/734 |
| 4,285,628 | A | | 8/1981 | Jankowski | 414/739 |
| 4,423,997 | A | | 1/1984 | Pemberton | 414/697 |
| 4,538,955 | A | | 9/1985 | Langenfeld | 414/686 |
| 4,565,485 | A | | 1/1986 | Wilman | 414/704 |
| 4,566,844 | A | | 1/1986 | Campin | 414/726 |
| 4,606,692 | A | | 8/1986 | Langenfeld | 414/686 |
| 4,787,811 | A | | 11/1988 | Langenfeld | 414/723 |
| 4,907,356 | A | | 3/1990 | Labounty | 37/406 |
| 4,928,410 | A | | 5/1990 | Walters | 37/409 |
| 4,930,974 | A | | 6/1990 | Langenfeld | 414/631 |
| 5,071,311 | A | * | 12/1991 | Foster et al. | 414/724 |
| 5,073,080 | A | | 12/1991 | Blum | 414/739 |
| 5,094,581 | A | | 3/1992 | Lamb | 414/24.5 |
| 5,121,557 | A | | 6/1992 | Moore | 37/406 |
| 5,184,934 | A | | 2/1993 | Gallo | 414/740 |
| 5,398,983 | A | | 3/1995 | Ahrens | 294/106 |
| 5,516,174 | A | | 5/1996 | Squyres | 294/86.41 |
| 5,518,359 | A | | 5/1996 | Pratt | 414/724 |
| 5,544,435 | A | | 8/1996 | Somero | 37/405 |
| 5,564,885 | A | | 10/1996 | Staben | 414/724 |

(Continued)

*Primary Examiner* — Donald Underwood
(74) *Attorney, Agent, or Firm* — Dowell Baker, P.C.

(57) ABSTRACT

The pinching fingers implement of the present invention provides independent grasping claws that can be independently opened or closed, and also independently rolled forward and backward, to provide for the secure and versatile grasping, manipulation and transport of irregular items. An attachment bracket may extend between two pairs of pinching fingers to allow connection of a secondary implement between the pinching fingers. The attachment bracket and the secondary implements may be structured such that the secondary implement may be attached without tools by rotating the pinching fingers forward, scooping up the implement, rotating the fingers backwards and securing the secondary implement with rotatable stands.

19 Claims, 21 Drawing Sheets

U.S. PATENT DOCUMENTS

| | | | | |
|---|---|---|---|---|
| 5,779,430 | A | 7/1998 | Ball | 414/724 |
| 5,865,492 | A | 2/1999 | Horton | 294/86.41 |
| 5,957,650 | A | 9/1999 | Rollo | 414/724 |
| 5,997,237 | A | 12/1999 | Langenfeld | 414/723 |
| 6,176,531 | B1 | 1/2001 | Wheeler | 294/88 |
| 6,308,440 | B1 | 10/2001 | Mueller | 37/404 |
| 6,526,678 | B2 | 3/2003 | Waddington | 37/406 |
| 7,566,197 | B2 * | 7/2009 | Westendorf et al. | 414/729 |

* cited by examiner

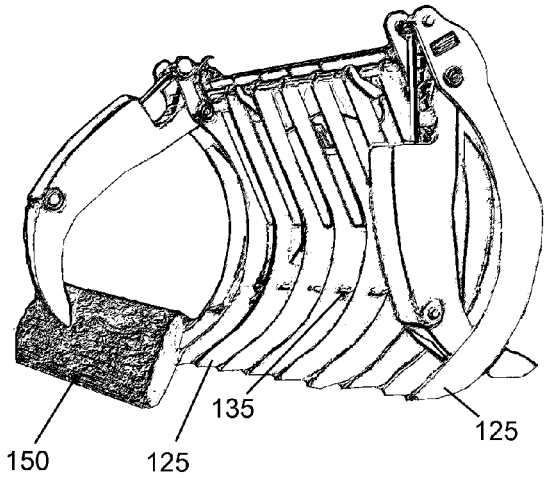
FIG. 18
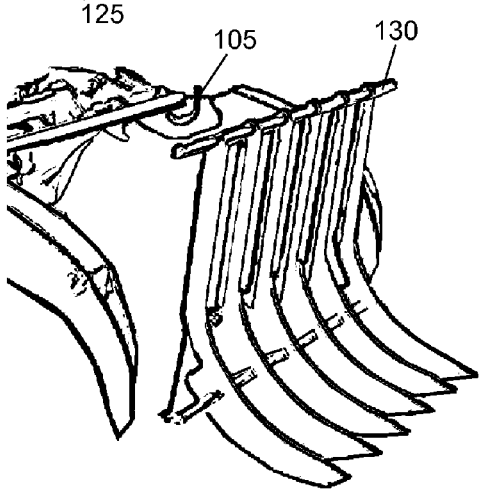
FIG. 19
FIG. 20A
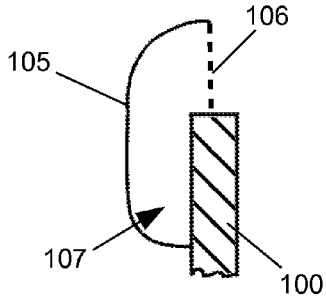
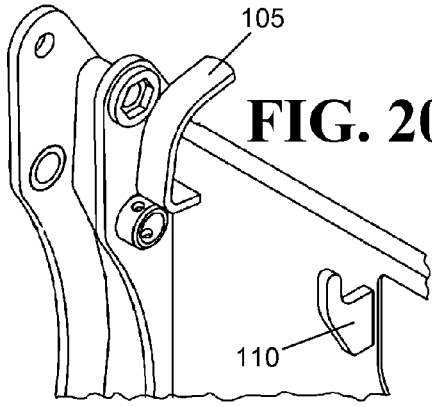
FIG. 20

INDEPENDENT HYDRAULIC PINCHING FINGERS WITH DETACHABLE SECONDARY IMPLEMENT

CROSS REFERENCE TO PENDING APPLICATION

This application is a continuation-in-part of and claims priority to U.S. application Ser. No. 11/222,642 entitled "Independent hydraulic pinching fingers attachment for utility vehicles" filed Sep. 9, 2005 by Neal Westendorf and Joseph Langenfeld, now issued as U.S. Pat. No. 7,566,197 the entire contents of which are herein incorporated by reference.

FIELD OF THE INVENTION

The present invention relates generally to implements for use with tractors, skid steers, backhoes and the like, and more specifically to a precise grasping and lifting attachment for use with such vehicles.

BACKGROUND OF THE INVENTION

Tractors and skid steers are common utility vehicles in the farming, construction and landscaping industries. The primary benefit of these vehicles is their great versatility and the wide variety of implements that can be attached to and used with the vehicle. After an initial investment in a tractor or skid steer, owners of these vehicles can add increased functionality by purchasing a wide variety of specialized implements including loaders, backhoes, blades, post hole diggers, forks and bale spears, to name a few. Because of the ubiquity and great versatility of tractors and skid steers, owners of these vehicles continuously seek new and improved implements to perform specialized tasks.

Grappling jaws are good examples of implements that are especially useful for performing specialized tasks. These implements are essentially large, heavy-duty jaws that can be opened and closed around material so that the material may be grasped, lifted and transported by the vehicle. Because these implements can be closed around the material or item, these implements expand the lifting and carrying capabilities of the utility vehicle.

Grappling jaws of various configurations have been developed for use with front end loaders and skid steers. In their most common form, grappling jaws have been adapted for use with the conventional loader bucket of these vehicles. For example, as shown in U.S. Pat. Nos. 5,094,581 and 5,957,650, the grappling jaw is attached to the bucket so that the jaw may be closed over the bucket to secure material being carried in the bucket. The grappling jaw is typically controlled by a hydraulic piston or multiple pistons that open and close the jaw relative to the bucket. Such grappling jaws can significantly increase the carrying capacity of the bucket and are useful for securing and controlling loose material carried in the bucket, as well as large, regularly shaped items such as hay bales.

Grappling jaws in this configuration, however, suffer many limitations. In particular, the bucket and grappling jaw combination is not well suited for highly precise grasping tasks. First, the bucket must be inserted beneath an item before the upper grappling jaws may be used to grasp the item. For items that are embedded in the ground, this is often not possible. Also, for irregular items or items that are laying at an angle to the ground, it is often difficult if not impossible to place the bucket securely against an item prior to grasping the item. The sides of the bucket also often impair the ability of the implement to grasp and carry items longer than the width of the bucket.

The weight of the bucket itself in these grappler configurations is also a significant disadvantage. Every utility vehicle has a maximum weight that it can effectively lift, handle and transport. The weight of the bucket must, of course, be included in this maximum weight capacity and, the heavier the bucket, the lower the lifting capacity of the vehicle.

In addition, the bucket often obscures the visibility of the operator, making it difficult for the operator to use the bucket and grappling jaw to grasp and carry certain items.

Grappling jaws with opposing tines or claws that interlock when closed have been developed that attempt to overcome some of these limitations. These implements, often referred to as grapple rakes, utilize a second set of tines or claws in place of the lower bucket to provide opposing claws that are better suited for grasping certain objects. For example, U.S. Pat. No. 6,098,320 discloses grappling jaws useful for dislodging and grasping large stones embedded in the ground. These grappling jaws include a lower set of tines that may be inserted in the ground beneath a stone and an upper set of tines that may then be closed around the stone. Opposing grappling jaws with an upper and lower set of tines are also disclosed in U.S. Pat. Nos. 6,176,531 and 6,601,891.

Although useful for certain tasks, these grapple rakes are not well suited for highly precise grasping tasks or for lifting and carrying irregularly shaped items such as fallen trees and brush. To provide structural stability and strength, the upper and lower sets of claws on these grapple rakes are typically constructed as unified or solid pieces that clamp in opposition on another. When grasping an item of uniform cross section, or material that may be easily crushed between the opposing jaws, these designs are adequate for securing the item. The additional weight of the intrinsic grapple rake also unnecessarily reduces the amount of weight that can be carried by the loader when the grapple rakes is not needed for the current task. Additionally, the intrinsic grapple rake may unnecessarily obstruct the visibility of a vehicle operator or the rake may unnecessarily interfere with the precise placement of the grappling claws when the current task does not require the rake.

However, when a solid item to be grasped has a tapered or irregular cross section, one claw may be restricted from closing on the item when the other claw closes on a larger portion of the item, causing the item to be held by only one claw and not the other. In this instance, the item cannot be safely transported without the danger of the item moving and shifting during transport.

To address this problem, grappling implements have been developed with upper fingers that may be closed independently of one another. For example, Bobcat Company offers Industrial Grapple and Industrial Fork Grapple implements with two sets of upper claws that may be closed independently of one another. Worksaver, Inc. also offers a Split-Top Grapple Rake with dual upper grapples that may also be closed independently of one another. Although these implements do provide increased control over bulky and irregularly shaped items, they do not offer the precision and control necessary for many tasks. In particular, these configurations do not provide a grasping implement that can be precisely placed around irregular items or obstructions and easily controlled by the operator for grasping and lifting irregular items.

Such features are especially useful for clearing fallen trees, branches and brush. Clearing such items presents specific challenges for the operator and the construction of the grasping implement. First, operator visibility and precise control are essential for precise placement of the fingers through limbs and branches prior to closing the fingers. Second, high strength of the fingers is essential so that smaller branches and brush may be crushed between the fingers. Third, the hydraulic cylinders and lines must be protected from damage from branches and limbs during operation. Thus, a grappling implement adapted for clearing fallen trees, branches and brush must offer high visibility, precise control, high clamping strength and protection for the hydraulic components.

As a result of the wide variety of tasks performed by loaders, an operator may need to routinely switch the loader implements for the current task. For example one implement may be used to move large logs to a burn pile while a second implement is needed to move smaller twigs and branches to the burn pile. Switching an implement often involves positioning the implement into a proper orientation so that it can be securely coupled to the loader. Other time consuming steps in the switching process may involve disconnecting and connecting pressurized hydraulic lines extending between the loader and the implement. In addition to increasing the amount of time needed to complete a series of tasks, switching implements may result in leaks of hydraulic fluid. Dirt and debris may also be introduced into the hydraulic system when the loader implement is changed.

Accordingly, an object of the present invention is to provide pinching fingers for a tractor, skid steer or the like that may move and grasp independently so that both claws can be used to grasp and safely transport irregularly shaped items such as fallen trees and brush.

An additional object of the present invention is to provide a grasping implement that does not obscure the visibility of the operator and provides precise control so that highly precise grasping operations may be performed.

Also, an object of the present invention is to provide pinching fingers with high clamping strength.

Another object of the present invention is to provide pinching fingers that protect the hydraulic cylinders and lines used to control the fingers.

A further object of the present invention is to provide pinching fingers that are easy to install and remove on a conventional loader or skid steer. An object of the present invention is to provide a secondary implement with an intrinsic stand so that when not in use the implement stays in an orientation where the coupling features are easily accessible. Another object of the present invention is to provide a stand that also acts to secure the implement to construction machinery when the implement is in use. Yet another object of the present invention is to provide an implement that may be customized for a particular task without having to disconnect the implement and hydraulic lines from the loader.

Another object of the present invention is to provide pinching fingers that can be quickly interchanged with other implements on a conventional loader or skid steer. Yet another object of the present invention is to provide a secondary implement that may be connected and disconnected from a primary implement without the use of separate tools.

A still further object of the present invention is to provide a pinching fingers attachment with sufficient structural stability and strength to grasp, lift and transport heavy items including logs, trees and other items.

Still another object of the present invention is to provide an improved vehicle with a pinching fingers attachment.

Another object of the present invention is to provide a backhoe with a single set of claws.

A further object of the invention is to provide a loader or skid steer with pinching fingers that are simple and easy to operate.

Finally, an object of the present invention is to provide a pinching fingers attachment that is economical to manufacture, durable and refined in appearance.

SUMMARY OF THE INVENTION

The preferred embodiment of the present invention provides a pinching fingers implement that can be used with conventional tractors, skid steers and other vehicles with arms for operating implements. Two independent sets of claws are attached to the end of each of the arms of the tractor or skid steer. In this position, the pinching fingers can be raised and lowered like a typical implement. The pinching fingers may also be rolled forwards and backwards for precise placement of the fingers prior to grasping and for precise release of an item being lifted and transported. Finally, the pinching fingers may be opened and closed to securely grasp an item being grasped and transported.

The left and right claws may be opened or closed independently of one another with separate hydraulic cylinders operated by separate hydraulic controls. In this embodiment, maximum versatility and control of the pinching fingers is obtained. In the preferred embodiment, however, the left and right claws are opened and closed in unison with separate hydraulic cylinders operated by a single set of hydraulic controls. In this configuration, the left and right claws may still be moved independently of one another (as discussed below) for precise placement of the fingers prior to grasping and secure grasping of an irregular item after placement. This configuration provides for ease of operation without significant loss of the ability to precisely control the fingers.

The independent pinching fingers of the present invention may be provided in various configurations. First, the bottom two pincer claws may be tied together with a lower stabilizer bar or an attachment bracket or a secondary implement that may be installed or removed without disconnecting the pinching fingers from a vehicle. In this configuration, the lower stabilizer bar or secondary implement attachment bracket provides increased stability and strength for the pinching fingers. When a secondary implement, such as a set of detachable teeth, is installed between two sets of pinching fingers the secondary implement may act to further strengthen and stabilize the pinching fingers.

The secondary implement attachment bracket and the secondary implements may be structured such that the secondary implement may be attached without tools by rotating the pinching fingers forward, scooping up the implement, rotating the fingers backwards and securing the secondary implement with rotatable stands.

Alternatively, the lower stabilizer bar may be omitted. In this configuration, the bottom pincer claws will still operate in unison when not obstructed. However, when faced with an obstruction, the bottom pincer claws remain capable of independent movement because the hydraulic cylinders that control the forward and backward roll of the fingers are connected in series. Thus, when the fingers are rolled backward and one bottom pincer claw meets an obstruction that stops its movement, the other bottom pincer claw may continue to roll backward until it also meets an obstruction. This feature allows for precise and secure placement of the bottom pincer claws on an irregularly shaped item prior to grasping by the upper pincer claws.

The upper pincer claws may also be tied together with an upper stabilizer bar. Preferably, however, the upper pincer claws are not connected so that they may more freely close independently. The upper pincer claws are controlled by hydraulic cylinders connected in series that open and close the upper pincer claws relative to the bottom pincer claws. When operated without obstruction, the upper pincer claws move in unison. However, when grasping an item with an irregular cross section, one the upper pincer claws will typically close upon and secure a larger portion of the item before the other upper pincer claw. Because the hydraulic cylinders controlling the upper pincer claws are connected in series, the other upper pincer claw will continue to close until it also secures the smaller portion of the irregular item. This feature allows for irregularly shaped items, in particular tree trunks, branches and limbs, to be securely grasped, lifted and moved with the pinching fingers of the present invention.

In one embodiment of the present invention, the lower claws of the pinching fingers are constructed with an integral implement stand extending down from the claws such that the implement rests upon the ground in an operational orientation when not in use. In addition to facilitating easy attachment of the implement to a loader, the integral stand keeps the implement orientated so that the amount of dirt and debris exposed to the hydraulic cylinders and hinges is minimized The pinching fingers of the present invention offer many advantages over prior art grappling implements. As previously noted, the four claws may all be operated independently, allowing for greater flexibility and versatility in grasping, securing, lifting and transporting irregular items. The pinching fingers are also light in weight, which increases the lifting capacity of the utility vehicle. The pinching fingers also grasp and hold items closer to the utility vehicle than conventional bucket and grappling jaw configurations, which further increases the lifting capacity of the vehicle.

The open configuration of the pinching fingers of the present invention also provides greater visibility, allowing for precise placement and operation of the fingers. The pinching fingers may also more easily be inserted though and around obstacles, which allows the fingers to be placed at the most advantageous lifting point, allowing items to be picked up regardless of the surrounding obstacles. The pinching fingers may also lowered directly around an item from above, rather than from the side, as with conventional grappling implements. This allows items to be picked up from above rather than scooped up from below, further enhancing the versatility of the present invention.

The pinching fingers of the present invention also provide high clamping strength so that brush and smaller limbs may be crushed between the fingers. The hydraulic cylinders and lines of the present invention are also located inside the upper fingers of the implement, thereby protecting these critical components during operation. The pinching fingers are easy to install and remove on a conventional tractor or skid steer and can be easily attached using conventional pins and bolts. Alternatively, a standardized quick release system may be used so that the pinching fingers may be even more quickly interchanged with other implements adapted for the quick release system.

The pinching fingers of the present invention are especially useful for transporting logs and clearing brush. The pinching fingers can be clamped around a log so that the log cannot roll when it is picked up, transported and unloaded, increasing the safety of working with large logs. The pinching fingers can also be clamped around irregularly shaped items such as fallen trees or heavy farm equipment, making it easier to lift and move such items than with prior art implements. In addition, the pinching fingers can be inserted into the ground to grasp and remove items embedded in or attached to the ground such as rocks, loose pavement, dislodged stumps and ground cover.

The pinching fingers of the present invention have also been adapted for use with skid steers having a coupler plate for attaching implements to the skid steer, as well as for use with a backhoe, as described below.

These and other advantages will become apparent as this specification is read in conjunction with the accompanying drawings and appended claims.

BRIEF DESCRIPTION OF THE DRAWINGS

FIG. 18 is a perspective view of pinching fingers with detachable loader teeth gripping an object.

FIG. 19 is a partial perspective view of pinching fingers oriented to pick up and secure a secondary implement.

FIG. 20 is a partial perspective view of features of an attachment bracket for securing a secondary implement to pinching fingers without the use of separate tools.

FIG. 20A is a cross-sectional side view of an attachment bracket for securing a secondary implement to pinching fingers without the use of separate tools.

The drawings are not necessarily to scale and certain details unnecessary for an understanding of the present invention have been omitted. The invention is not limited to the particular embodiments illustrated herein.

DETAILED DESCRIPTION

The present invention may be used with any vehicle having an arm or arms for raising and lowering, and also rolling forward and backward, an implement. Although the preferred embodiment of the present invention is intended and adapted for use with a loader or skid steer, those of skill in the art will recognize that the present invention is equally adaptable for use with other utility vehicles. However, for descriptive purposes, the present invention will be described in use on a tractor and/or skid steer. Another embodiment of the present invention is intended for use with a backhoe.

Figure 1:
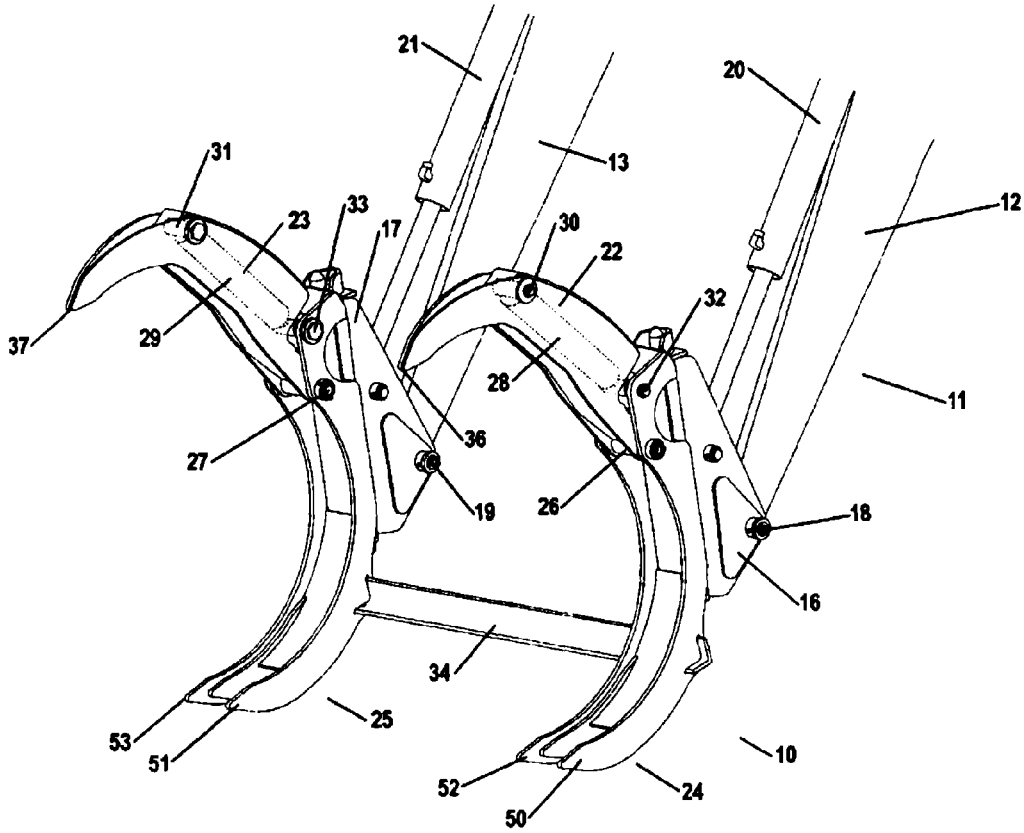
FIG. 1 is a perspective view of a front end loader with the pinching fingers of the present invention.

FIG. 1 shows the pinching fingers 10 of the present invention attached to a front end loader 11. The front end loader 11 includes a left arm 12 and a right arm 13 that are raised and lowered by a left lift cylinder and the right lift cylinder (not shown). The front end loader 11 also includes a left coupler 16 attached to the left arm 12 at the left coupler pivot point 18 and a right coupler 17 attached to the right arm 13 at the right coupler pivot point 19 so that the couplers rotate about the respective coupler pivot points. The couplers 16 and 17 are also attached to the left coupler cylinder 20 and the right coupler cylinder 21 which rotate the couplers backward and forward about the coupler pivot points.

The pinching fingers 10 include a left top pincer claw 22, a right top pincer claw 23, a left bottom pincer claw 24 and a right bottom pincer claw 25. The left bottom pincer claw is comprised of two tines 50 and 52 and the right bottom pincer claw is comprised to two tines 51 and 53. The left bottom pincer claw 24 is attached to the left coupler 16 and the right bottom pincer claw 25 is attached to the right coupler 17. The bottom pincer claws 24 and 25 may be fixedly attached to the couplers 16 and 17, but are preferably attached to the couplers by quick connect means (described below in connection with FIGS. 9 and 10) that allow the pinching fingers to be quickly replaced with other front end loader implements.

The top pincer claws 22 and 23 are attached to the bottom pincer claws 24 and 25 at the pincer claw pivot points 26 and 27. A left pincer claw cylinder 28 is enclosed within the left top pincer claw 22 and a right pincer claw cylinder 29 is enclosed with the right top pincer claw 23. The pincer claw cylinders 28 and 29 are attached to the top pincer claws 22 and 23 at the top pincer claw cylinder connection points 30 and 31 and attached to the bottom pincer claws 24 and 25 at the bottom pincer claw cylinder connection points 32 and 33. The pincer claw cylinders 28 and 29, as will be described more fully below, operate to open and close the top pincer claws 22 and 23 relative to the bottom pincer claws 24 and 25.

Figure 6:
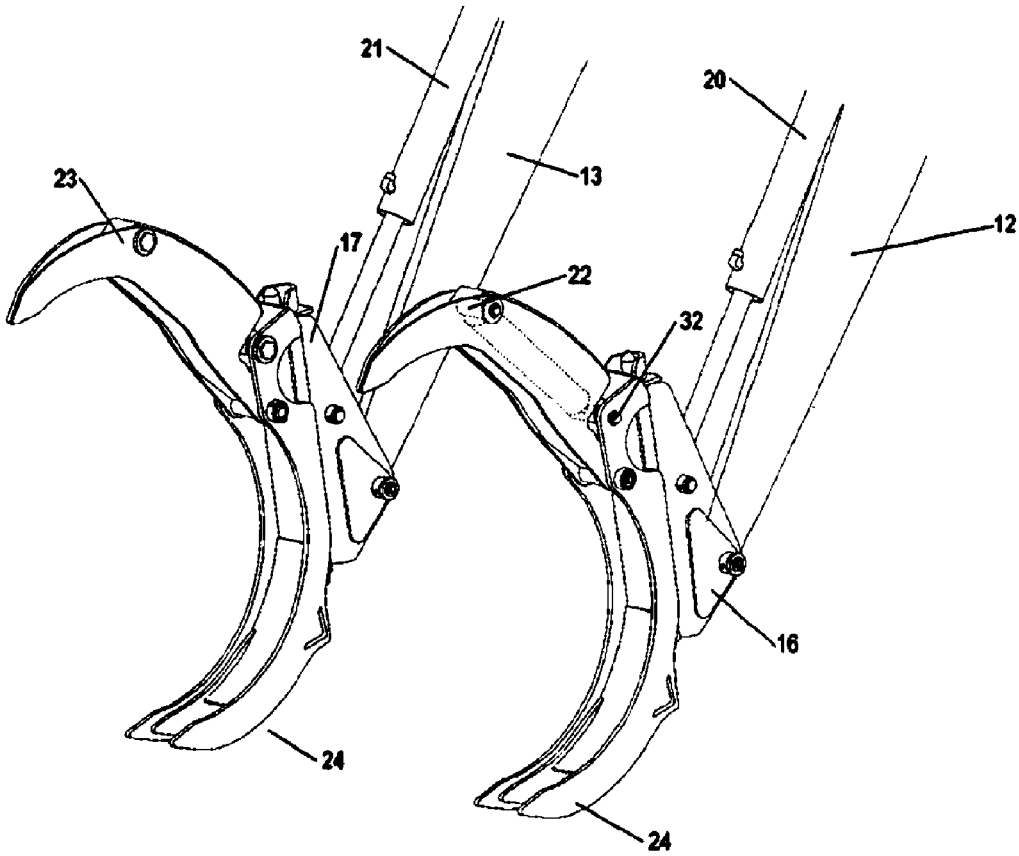
FIG. 6 is a perspective view of the pinching fingers of the present invention without a lower stabilizer bar, thus allowing for fully independent movement of the lower claws relative to one another.
Figure 7:
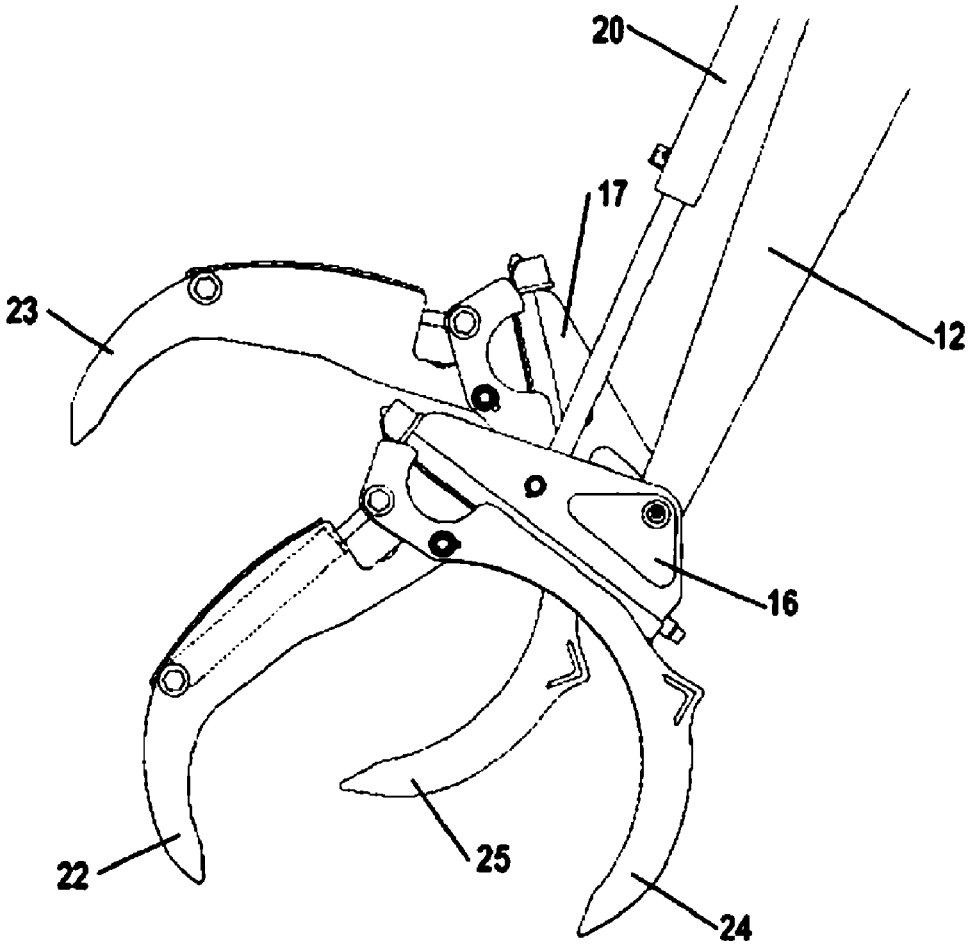
FIG. 7 is a side view of the pinching fingers of the present invention showing the fully independent movement of both the top and bottom claws.
Figure 8:
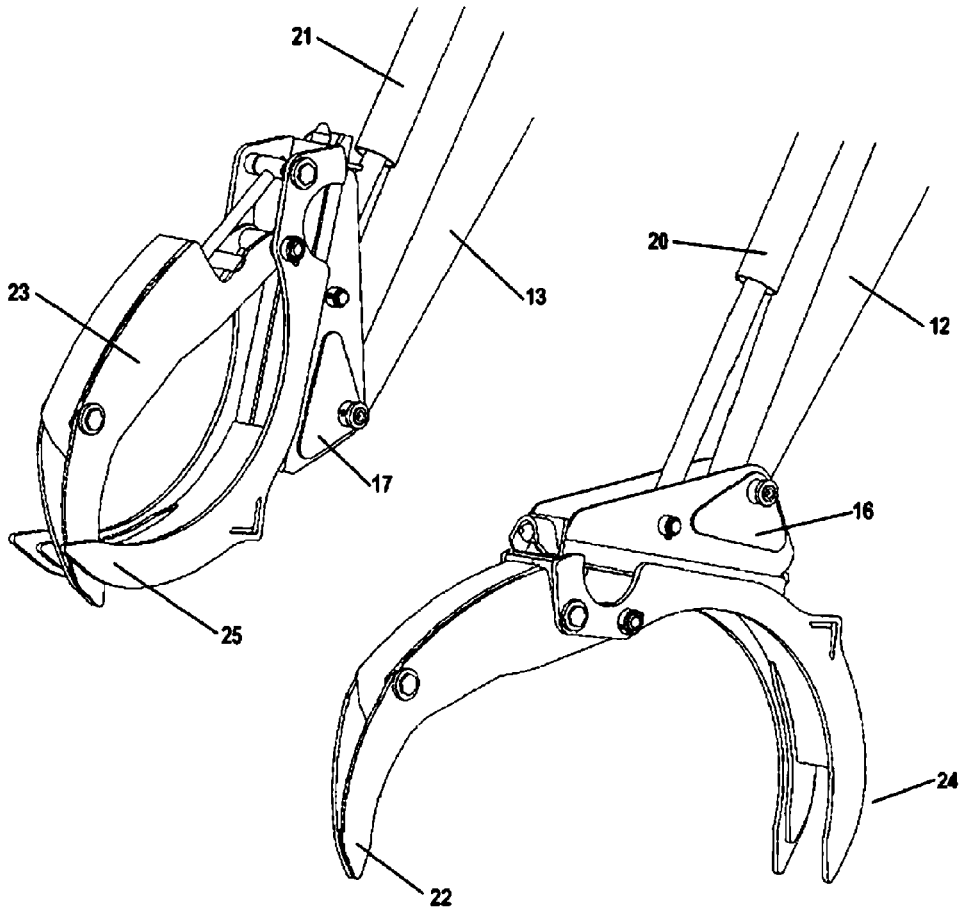
FIG. 8 is a perspective view of the pinching fingers of the present invention showing the fully independent movement of both the top and bottom claws.

The bottom pincer claws 24 and 25 may be connected with a lower stabilizer bar 34 that is fixedly connected at each end to the bottom pincer claws, as shown in FIG. 1. As will be described more fully below, the lower stabilizer bar 34 provides increased stability and strength for the pinching fingers. However, for increased precision and control of the bottom pincer claws, the lower stabilizer bar may be omitted, as shown in FIGS. 6-8. A removable lower stabilizer bar may also be provided that is attached to the bottom pincer claws when increased stability is required but removed when increased precision and control is desired. An upper stabilizer bar may also be provided, but would typically not be included due to the desirability of fully independent movement of the top pincer claws.

Figure 2:
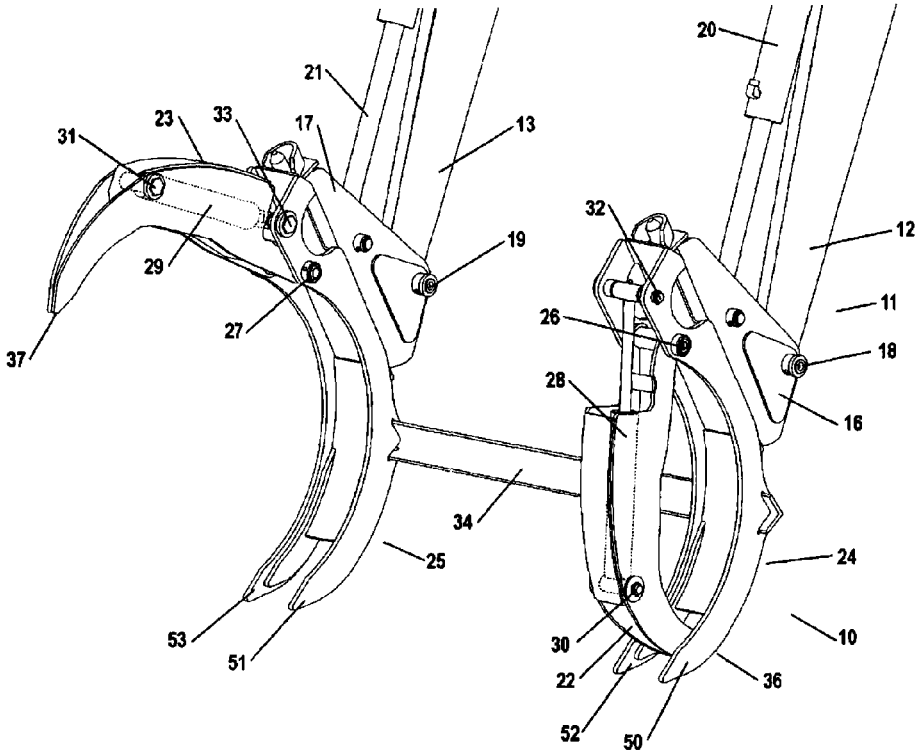
FIG. 2 is a perspective view of a front end loader with the left claws (shown on the right side of the drawing) of the pinching fingers in a closed position and the right claws of the pinching fingers in an open position.

The top pincer claws 22 and 23 are preferably comprised of flat metal plates that are spaced apart to provide an enclosure for the pincer claw cylinders 28 and 29 but taper towards one another and are welded together at the tips 36 and 37 of the claws. The bottom pincer claws 24 and 25 are preferably comprised of flat metal plates that remain spaced apart at the tips of the claws. In this configuration, the top pincer claws 22 and 23 insert through the bottom pincer claws 24 and 25 when the pinching fingers are closed, as shown in FIG. 2. In FIG. 2, the left claw is in a fully closed position with the tip 36 of the left top pincer claw 22 inserted through the left tines 50 and 52 of the left bottom pincer claw 24. As the claws are closed to the fully closed position, the curvature of the claws serve to draw an item into the claws and closer to the utility vehicle. This feature further increases the lifting capacity of the utility vehicle because the item is held as close as possible to the vehicle, reducing the lifting moment created by the weight of the item.

Figure 3:
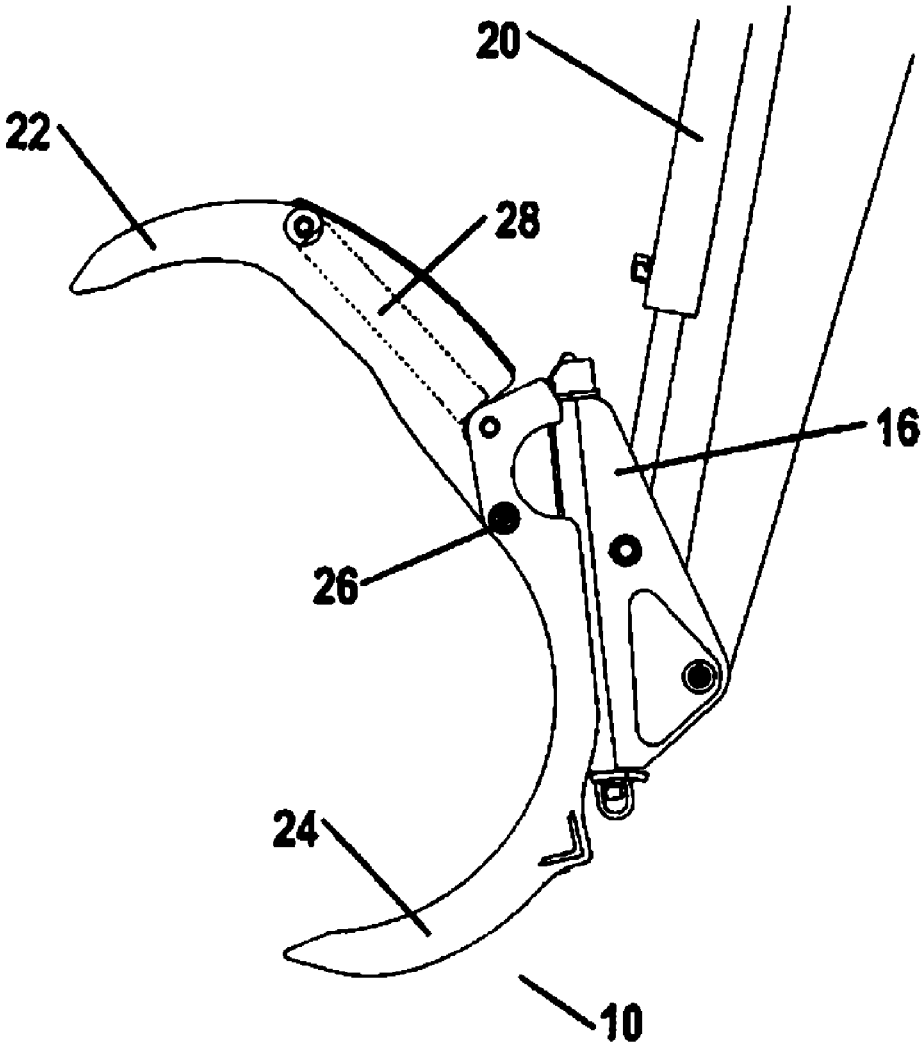
FIG. 3 is a side view of a front end loader with the pinching fingers of the present invention in a fully open position.
Figure 4:
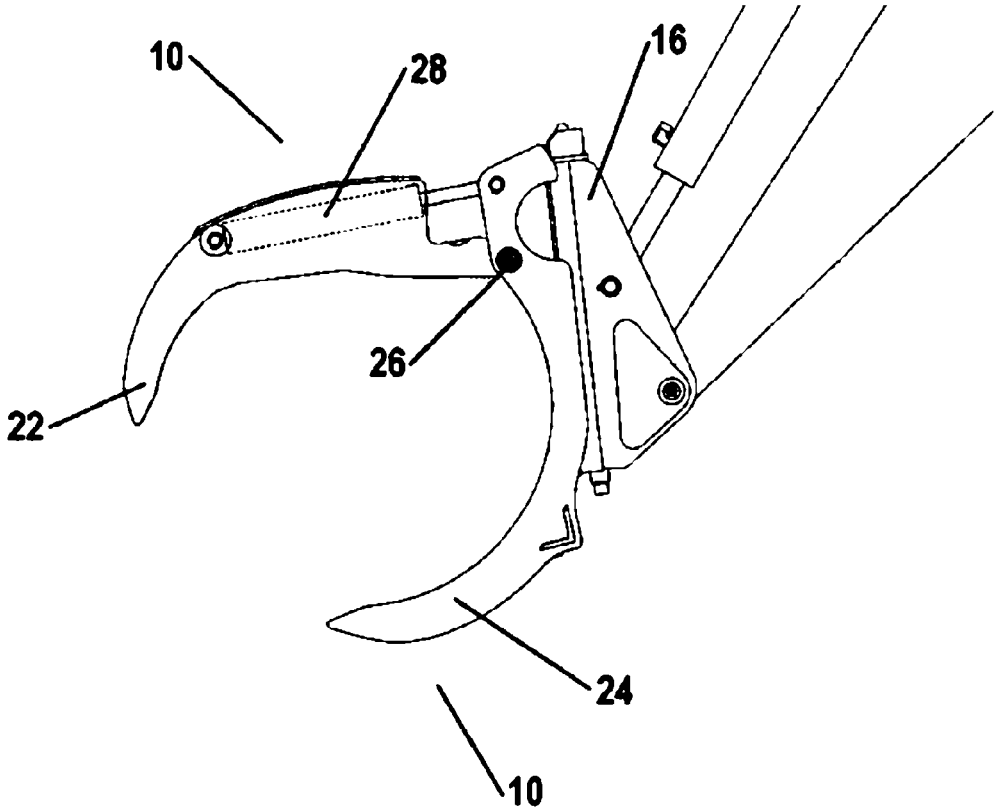
FIG. 4 is a side view of a front end loader with the pinching fingers of the present invention in an intermediate position.
Figure 5:
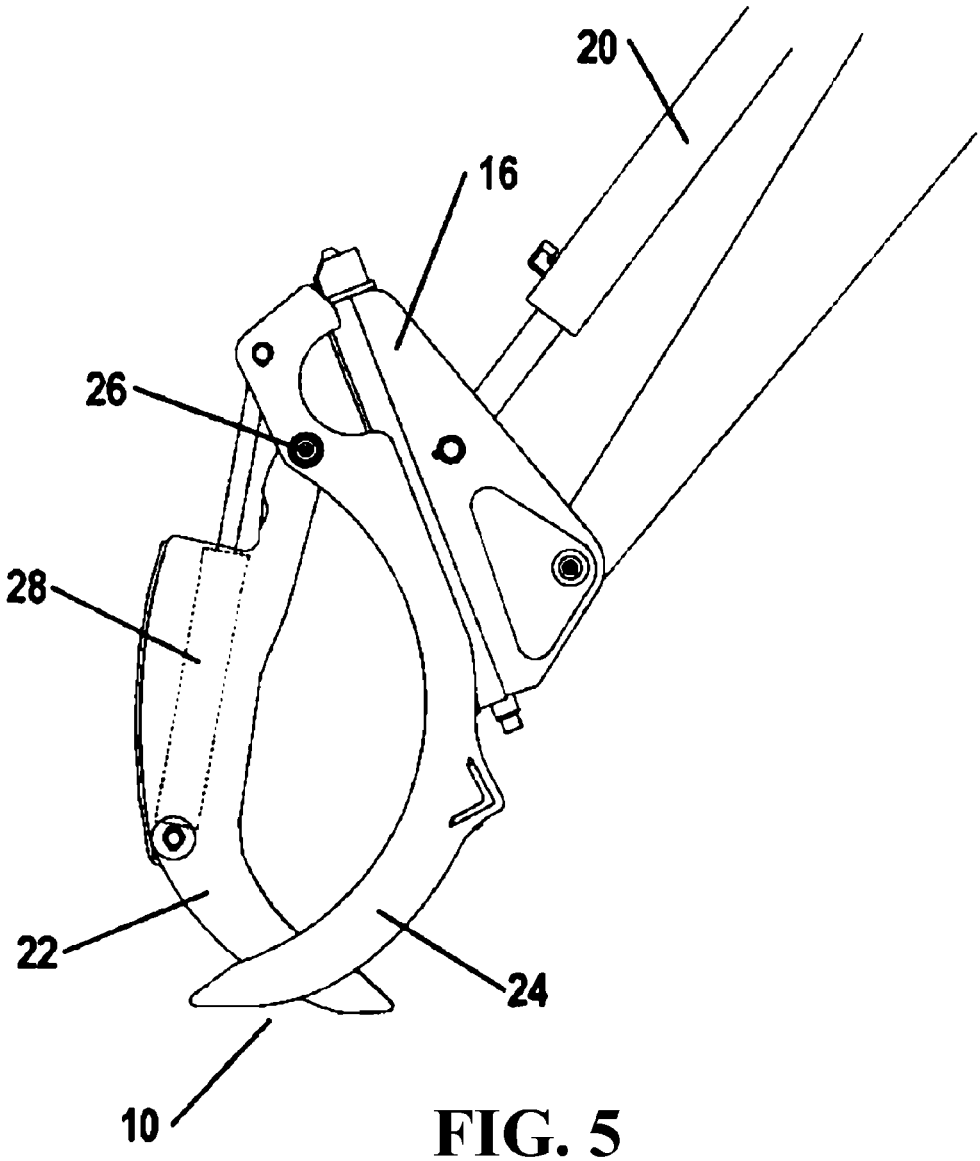
FIG. 5 is a side view of a front end loader with the pinching fingers of the present invention in a fully closed position.

The pinching fingers 10 are raised and lowered by the lift cylinders (not shown). The coupler cylinders 20 and 21 roll the pinching fingers 10 forward and backward by rotating the couplers 16 and 17 to which the bottom pincer claws 24 and 25 are attached. As shown in FIGS. 3-5, the pincer claw cylinder 28 opens and closes the pinching fingers 10 by causing rotation of the top pincer claw 22 about the pincer claw pivot point 26.

In FIG. 3, the pinching fingers 10 are shown in the fully open position. By extending the pincer claw cylinder 28, as shown in FIG. 4, the top pincer claw 22 is rotated about the pincer claw pivot point 26 to close relative to the bottom pincer claw 24. With the pincer claw cylinder 28 fully extended, as shown in FIG. 5, the pinching fingers 10 are fully closed.

The coupler cylinders 20 may be controlled with independent hydraulic controls, but are conventionally controlled in unison by the same hydraulic controls. The coupler cylinders are conventionally and preferably connected in series so that, if the movement of one cylinder is restricted, power is transferred to the other cylinder. This feature allows for independent movement of the left and right pinching fingers.

With the lower stabilizer bar 34 connecting the bottom pincer claws 24 and 25, the independent movement of the left and right pinching fingers is limited, providing increased stability for the pinching fingers. However, due to flexing of the bar, some independent movement remains possible. With the lower stabilizer bar 34 omitted or removed, as shown in FIG. 6, independent movement of the left and right pinching fingers is provided for increased control and more precise placement of the pinching fingers when grasping irregular items such as a fallen tree.

When grasping such an item, the open pinching fingers may be rolled backward until one of the bottom pincer claws comes into contact with the fallen tree. The coupler cylinders will continue to roll the other bottom pincer claw backward because power is transferred from the obstructed claw to the unobstructed claw. This feature is shown in FIG. 7 which illustrates the position of the claws with the right pincer claws 23 and 25 rotated farther backwards than the left pincer claws 22 and 24. When the unobstructed claw also comes into secure contact with the fallen tree, the upper top pincer claws 22 and 23 may be closed around the tree to securely grasp it.

The left and right pincer claw cylinders 28 and 29 may also be controlled with separate hydraulic controls. In this configuration, the pinching fingers may be freely opened and closed at will, which provides some measure of increased flexibility in certain operations. The left and right pincer claw cylinders 28 and 29 are preferably, however, connected in series so that the pincer claw cylinders, like the coupler cylinders, may transfer power to one another when one of the top pincer claws 22 or 23 is obstructed.

This feature is particularly useful for grasping irregular items, and provides a key benefit over prior art grasping implements. As the pinching fingers are closed, one of the top pincer claws 22 or 23 will come into contact with the item being grasped. The pincer claw cylinders 28 and 29 will continue to close the other top pincer claw because power is transferred from the obstructed top pincer claw to the unobstructed top pincer claw. When the unobstructed claw also comes into secure contact with the irregular item, the item will be securely held in the pinching fingers. Thus, as shown in FIG. 8, the left and right claws may be rotated separately and also closed separately to provide the greatest versatility for precise placement and secure grasping of the implement.

This feature allows for secure grasping of an irregular item before the item is ever moved. By contrast, prior art grappling implements must typically lift or move an irregular item in order to get a secure grasp on the item. With large, cylindrical objects, such as logs, large pipes or culverts, this lifting or movement could cause the item to roll or shift, which increases the danger of working with such items. The pinching fingers of the present invention may securely grasp an item prior to lifting or moving the item, which greatly increases the safety and precision of moving certain items.

The configuration and features of the present invention provide many other advantages over prior art grappling implements. The open space between the fingers allows an operator a clear view of an item to be grasped and transported. With this open space and clear view, the pinching fingers can be precisely placed on an item, even if the item is located among other items or obstacles. The present invention may precisely pick an item from a point no wider that either of the fingers. By contrast, a bucket and grappling jaw combination requires an open space at least as wide as the width of the bucket for the implement to be used. Also, when grasping a fallen tree, the pinching fingers can be precisely placed among and between branches in the precise location needed to securely grasp the tree. Such precise placement is not possible with prior grapple rakes, making them less desirable for working with trees and brush.

The present invention is also particular useful for lifting and moving farm and tractor implements, industrial items such as welding jigs and even carts. One would not even consider moving such items with conventional grappling implements. Farm and tractor implements, which are often stored outside on the ground, must typically be moved by reconnecting the implement to a vehicle, which can be a time consuming and troublesome task. The pinching fingers of the present invention can be gently placed on such irregular and bulky items so that the item can be quickly moved. This ease of movement allows, for example, an operator to move an item, quickly mow grass where the item was located, and then return the item to its previous location.

The light weight of the pinching fingers of the present invention is also a great advantage. Conventional grappling implements can weigh as much as 800 to 1,000 pounds. The weight of the pinching fingers described herein is only approximately 320 pounds. Thus, the lifting capacity of a vehicle can be increased approximately 500 to 700 pounds through the use of the present invention. In addition, the present invention holds a payload closer to the vehicle as compared to other grappling implements, further increasing the lifting capacity of a vehicle using the pinching fingers described herein.

Figure 9:
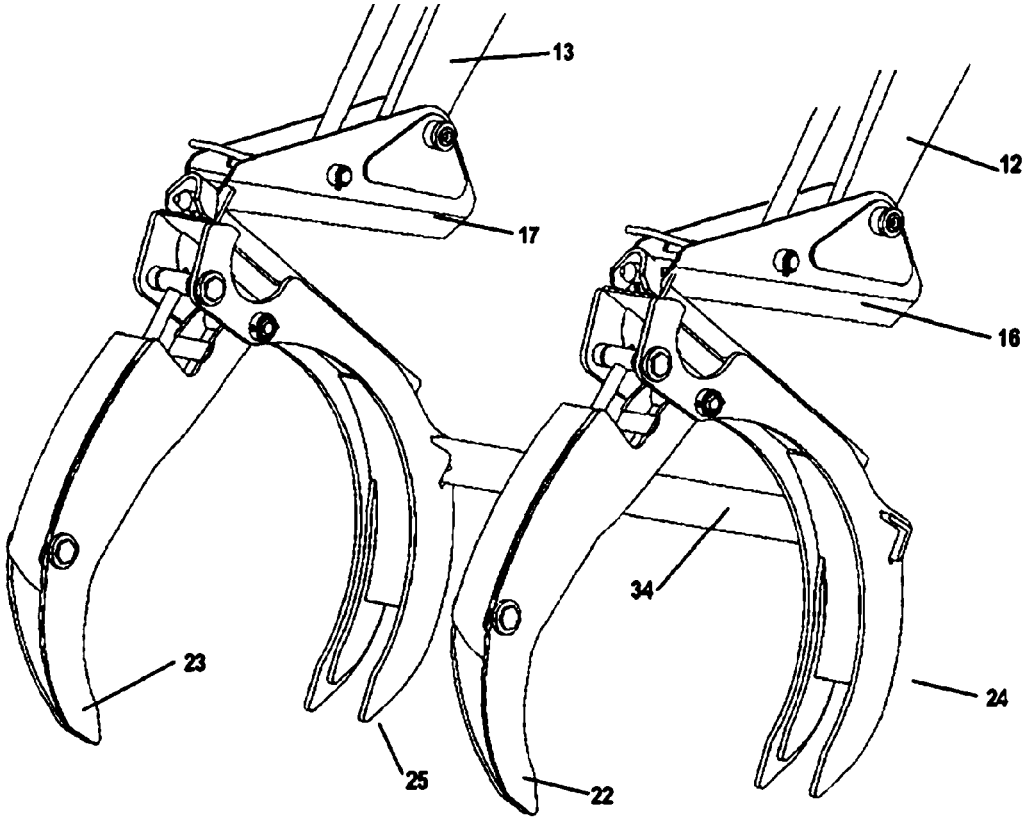
FIG. 9 is a front perspective view of the pinching fingers of the present invention showing a quick release mechanism for attachment of the pinching fingers to a utility vehicle.
Figure 10:
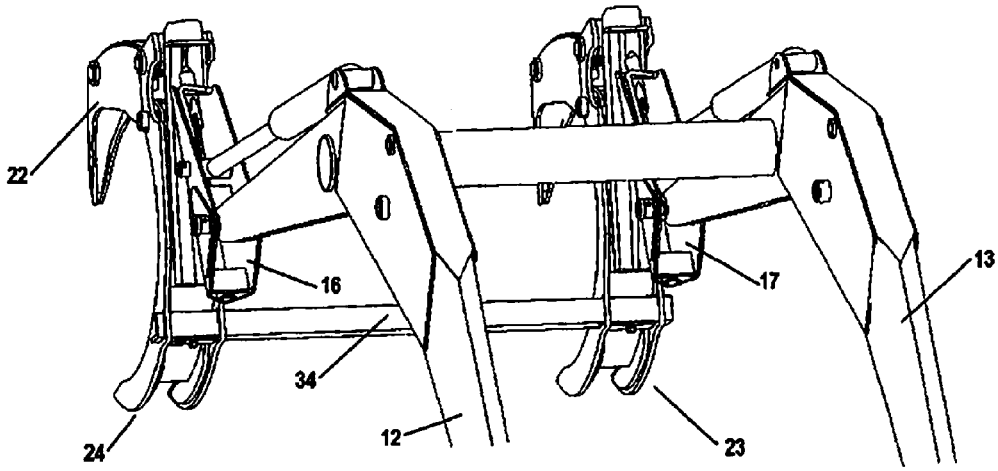
FIG. 10 is a rear perspective view of the pinching fingers of the present invention showing a quick release mechanism for attachment of the pinching fingers to a utility vehicle.

The pinching fingers of the present invention are preferable connected to a utility vehicle using a quick connect system as shown in FIGS. 9 and 10. This quick connect system allows the pinching fingers of the present invention to be quickly installed and removed on the utility vehicle.

Although the bottom pincer claws 24 and 25 may be attached to separate couplers as shown in FIG. 1, the bottom pincer claws may also be attached to a coupler plate as is found on many skid steers (not shown). In this configuration, the coupler plate, and in turn the pinching fingers, may be rolled forward and backward by a single hydraulic cylinder attached to the coupler plate, or multiple hydraulic cylinders attached to the coupler plate. Although this configuration necessarily ties the bottom pincer claws together for uniform movement and increased stability, the operation of the pinching fingers of the present invention remains essentially unchanged. Alternatively, the top pincer claws may be attached to a coupler plate and the bottom pincer claws controlled by hydraulic cylinders to open and close the claws. The inventors of the present invention contemplate these and other alternative configurations of the present invention.

Figure 11:
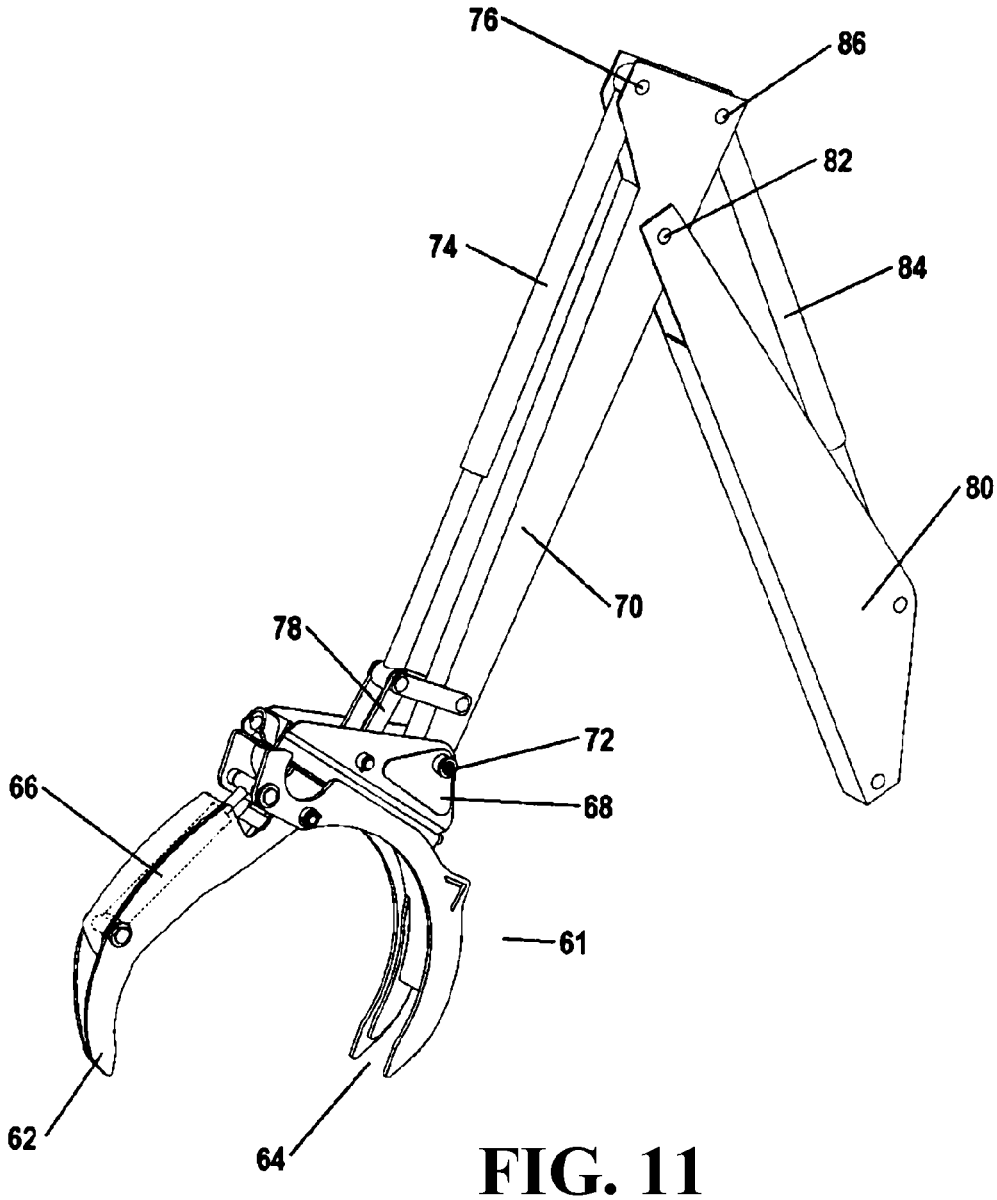
FIG. 11 is a perspective view of a single set of claws of the pinching fingers of the present invention attached to a backhoe.
Figure 12:
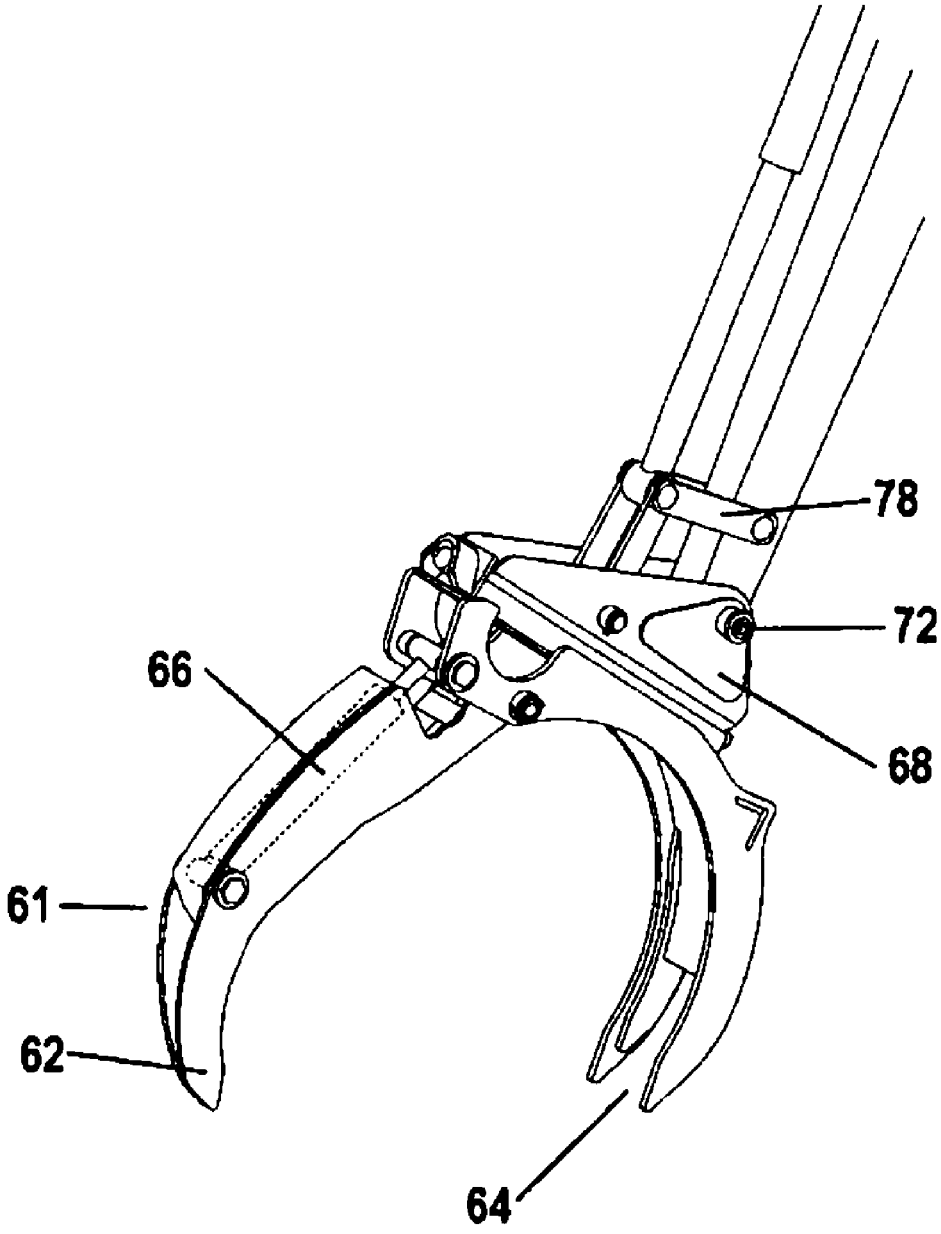
FIG. 12 is a closer perspective view of a single set of claws of the pinching fingers of the present invention attached to a backhoe.
Figure 13:
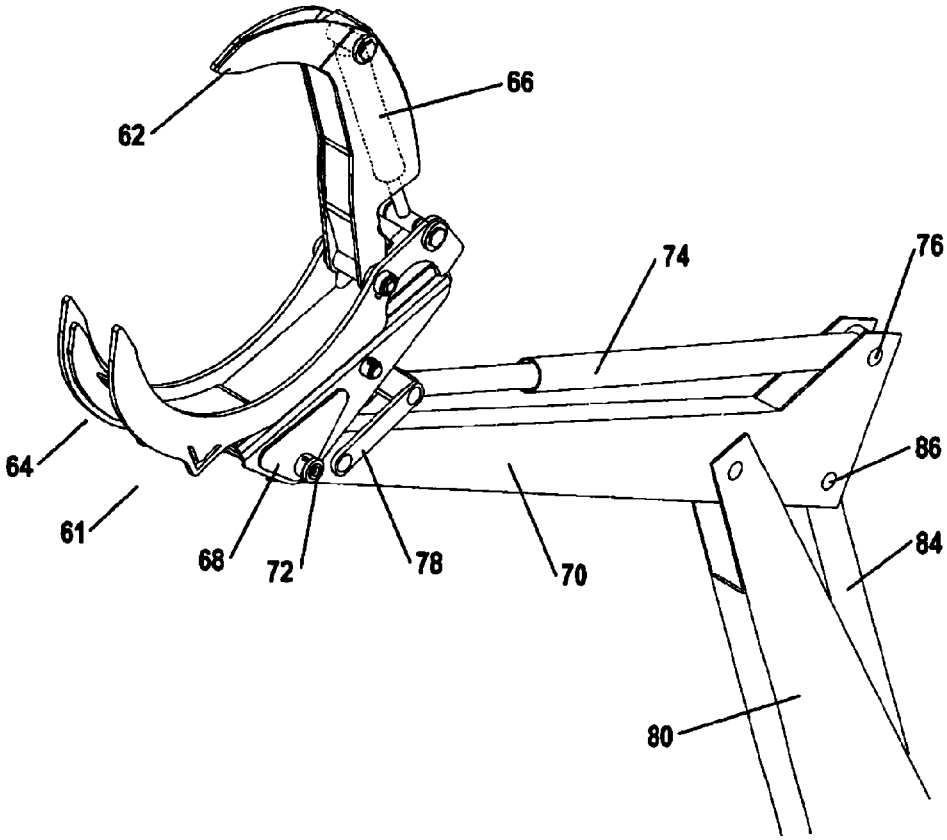
FIG. 13 is a perspective view of a single set of claws of the pinching fingers of the present invention attached to a backhoe and showing the capability of rotation of the claws.

As shown in FIGS. 11-13, a single set of claws of the pinching fingers of the present invention may also be used with a backhoe. A backhoe is primarily designed for digging and includes a bucket that may be rotated forward and backward, moved forward and backward, raised and lowered and rotated laterally. With the bucket replaced by a single set of claws, these same powered movements may be used to operate an effective and versatile grappling implement.

As shown in FIG. 11, a single set of claws 61 including a top claw 62 and a bottom claw 64 have been attached to a backhoe 60 in place of the conventional bucket. A closer view of the single set of claws 61 is shown in FIG. 12. The top claw 62 may be opened and closed relative to the bottom claw 64 by the pincer claw cylinder 66 in the same manner as described above.

The bottom claw 64 is connected to a coupler 68 that is in turn connected to the first arm 70 at the pivot point 72. A rotation cylinder 74 is also connected to the first arm 70 at the connection point 76 and the coupler 68 through the linkage 78. The first arm 70 is connected to a second arm 80 at the connection point 82. A lift cylinder 84 is connected to the first arm 70 at the connection point 86.

Thus, upon activation of the rotation cylinder 74, the coupler 68 and the single set of claws 61 connected to the coupler 68 may be rotated forward and backward. Upon activation of the lift cylinder 82, the claws 61 may be raised and lowered. As shown in FIG. 13, the claws 61 have been rotated backward by retraction of the rotation cylinder 74 and lifted by retraction of the lift cylinder 84. Upon activation of lateral rotation cylinders (not shown), the claws 61 may be also be rotated laterally left and right. The claws 61 may also be opened and closed by a pincer claw cylinder 66 enclosed in the top claw 62.

When attached to a backhoe as shown in FIGS. 11-13, the single set of claws offers many advantages. The wide range of movement of the backhoe and the high strength and light weight of the claws allow for extremely precise yet powerful grasping and lifting operations. The light weight of the claws allows for very heavy items to be manipulated and moved by the backhoe. Cumbersome and awkward items may be easily moved, manipulated and precisely placed with the backhoe. Buildings and structures may also be effectively and precisely demolished with individual items easily sorted and picked from the rubble upon demolition. In summary, the backhoe grappling implement of the present invention offers advantages and opportunities for use heretofore unknown to any utility vehicle implement.

Figure 14:
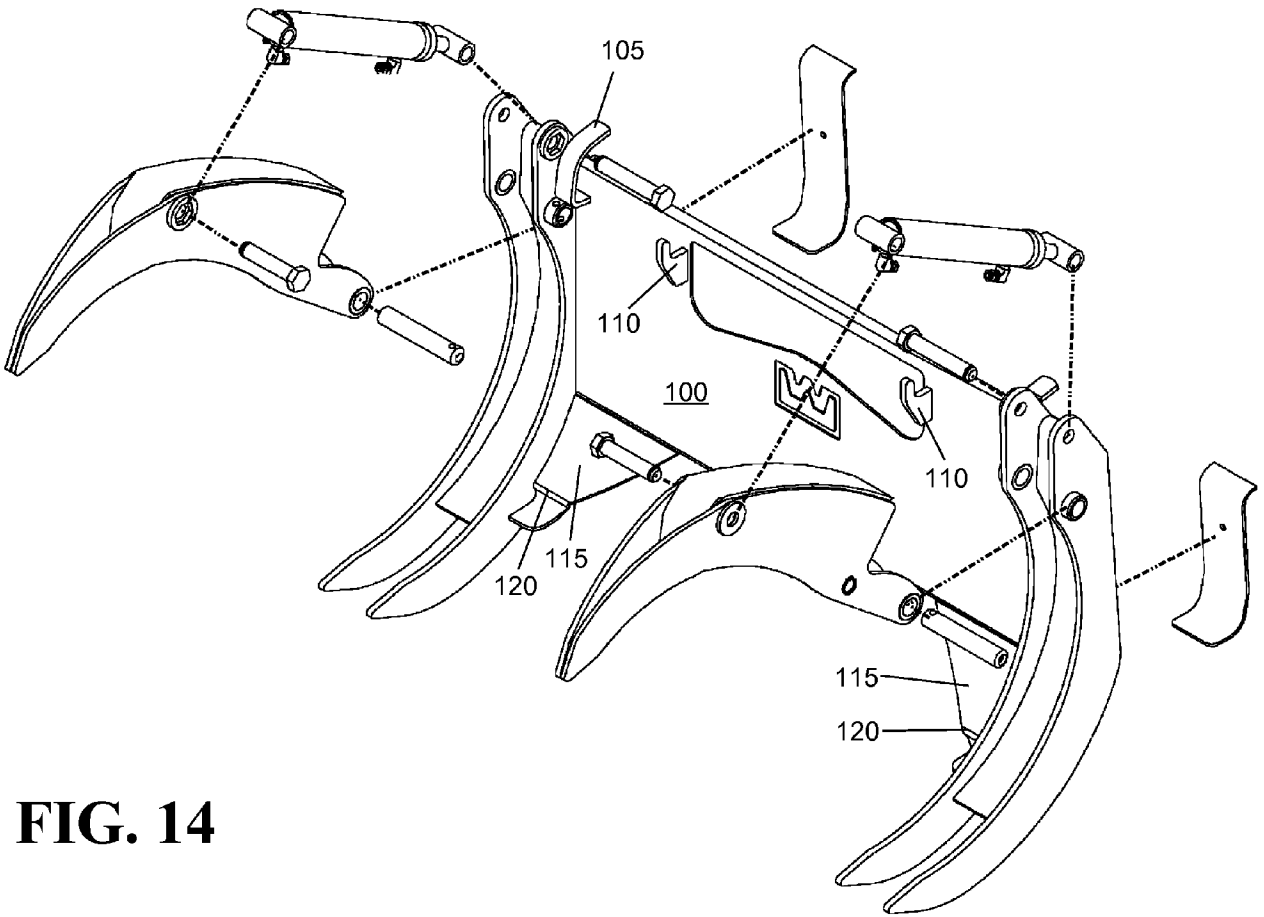
FIG. 14 is an exploded perspective view of a dual set of pinching fingers with an attachment bracket spanning between the lower claws of the pinching fingers.

FIG. 14 shows an exploded view of a pinching finger assembly having an attachment bracket 100 extending between the first and second pinching fingers. The attachment bracket 100 includes rotation locking arms 105 and locking support tabs 110 that allow a secondary implement to be securely coupled to the attachment bracket 100 without the use of separate tools. The rotation locking arms 105 are rotatable such that when the pinching fingers are rotated forward, the rotation locking arms allow a horizontal locking bar of a secondary implement to be lowered between the rotation locking arms 105 and the back plate of the attachment bracket 100. When the pinching fingers are rotated backwards, the secondary implement slides down the rotation locking arms 105 towards the locking support tabs 110. The implement then swings down towards the bottom section 115 and the bar groove 120 of the attachment bracket. The horizontal locking bar of the implement is then secured to the support tabs 110 of the attachment bracket 100 by the weight of the secondary implement. The bottom section 115 provides a substantial amount of support to the secondary implement when the pinching fingers are rotated backwards such as when an object is elevated by the secondary implement. The bar groove 120 acts to frictionally secure the secondary implement when the pinching fingers are rotated forward, however when the secondary implement is driven into the ground by the pinching fingers the secondary implement will be released from the bar groove 120 if a secondary locking means is not employed.

Figure 15:
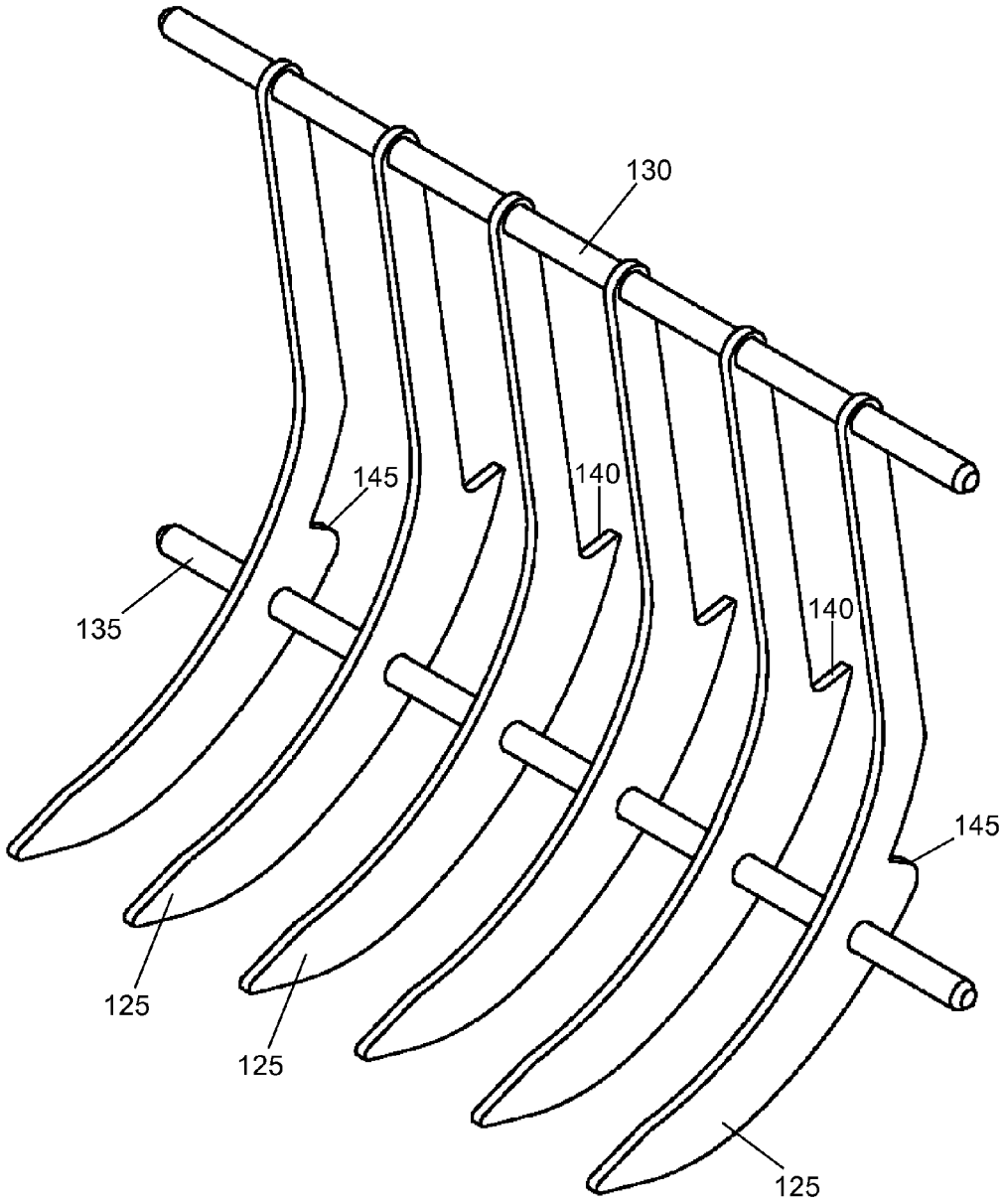
FIG. 15 is a perspective view of detachable implement teeth structured to connect to the attachment bracket of FIG. 14 wherein the most lateral teeth are adapted to connect to the lower claws of the pinching fingers.

FIG. 15 illustrates an example of a secondary implement having a plurality of teeth 125. The implement includes a horizontal locking bar 130 that is structured to be secured into the rotation locking arms and the support tabs of an attachment bracket. Extending between the plurality of teeth 125 is a support bar 135 that acts to provide rigidity to the plurality of teeth and also interacts with the bar groove of the attachment bracket. The inner teeth have corner sections 140 adapted to be secured to the back plate of the attachment bracket, while the outer teeth of the secondary implement have crooks 145 designed to be secured to the bottom sections of the attachment bracket. In an exemplary embodiment, the teeth are spaced to gather small twigs and branches while allowing soil to fall away from the load through the gaps in the teeth.

Figure 16:
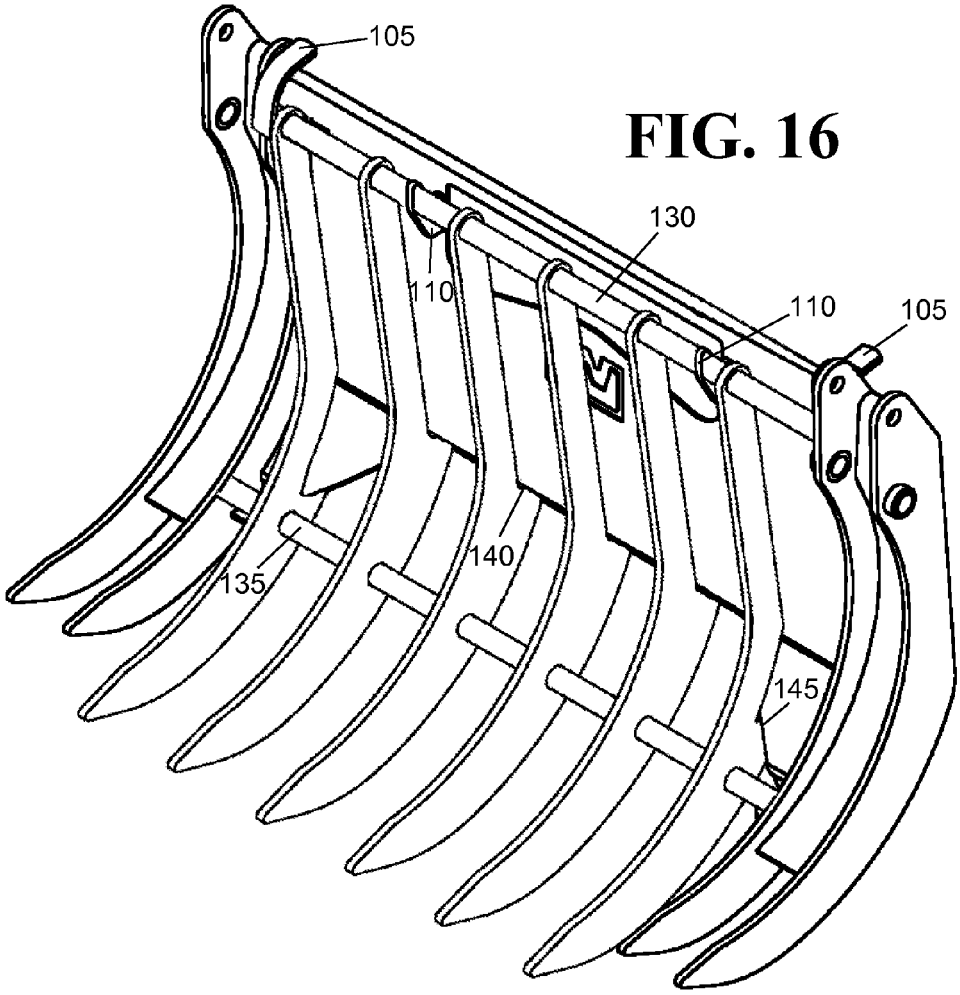
FIG. 16 is a perspective view of detachable implement teeth connected to the attachment bracket spanning between the claws of the pinching fingers.
Figure 17:
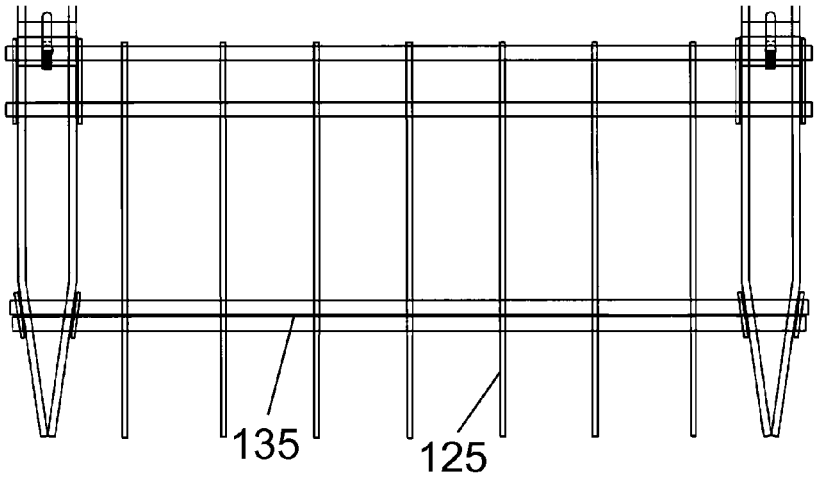
FIG. 17 is a front view of detachable implement teeth connected to the rigid attachment bracket spanning between the claws of the pinching fingers.

FIG. 16 illustrates an example of a secondary implement secured to an attachment bracket extending between pinching fingers. The horizontal locking bar 130 of the secondary implement is secured to the attachment bracket by the rotation arms 105 and the support tabs 110. The support bar 135 of the secondary implement is secured in the bar groove 120 of the attachment bracket. Further connection support between the implement and the bracket is provided by the corner sections 140 and the crooks 145 of the secondary implement interacting with the attachment bracket. FIG. 17 shows a front view of a secondary implement secured to an attachment bracket extending between two pinching fingers.

FIG. 18 shows an example of pinching fingers with a secondary implement grasping an object 150. The object 150 is held by an upper claw of a pinching finger along with the lower claw of the pinching finger and a tooth 125 of the secondary implement. The support bar 135 of the secondary implement helps to prevent the teeth 125 from deforming as a result of the object 150 pressing upon it. The pressure upon the teeth 125 acts to press the support bar 135 into the bar grew 120 of the attachment bracket.

FIG. 19 illustrates a secondary implement with on implement stand 155 that maintains the horizontal locking bar 130 of the secondary implement in an elevated position to facilitate locking into the rotation arms of the attachment bracket. In FIG. 19 the pinching fingers are rotated forward such that the rotation locking arms 105 may be used to scoop up and secure the horizontal locking bar 130 of the secondary implement with the use of separate tools. By rotating the pinching fingers backwards the secondary implement swings back and is secured to the bottom section of the attachment bracket. Conversely, when a secondary implement is secured to the attachment bracket of the pinching fingers, the secondary implement may be removed by simply rotating the pinching fingers to a forward orientation and lowering the rotation arms 105 away from the horizontal locking bar 130 of the secondary implement.

FIG. 20 shows a close up view of the rotation locking arm 105 and support tab 110 of the attachment bracket extending between pinching fingers. In one embodiment of the device, the support tab 110 acts to provide most of the support necessary to keep the secondary implement secured against the attachment bracket when the pinching fingers are not in a forwardly rotated orientation. In an alternate embodiment of the device, the rotation locking arm is robust enough to withstand the operational forces exerted on the secondary implement and the locking support tabs are omitted. In the illustrated example, the rotation locking arms 105 act to guide the horizontal support bar of the secondary implement into the support tabs 110 as the pinching fingers are rotated backwards. FIG. 20A illustrates a cross-sectional view of the rotation locking arm 105 of FIG. 20 wrapping around a attachment bracket 100. The arm and bracket form an opening 106 that is substantially vertically oriented when the pinching fingers are rotated backwards, however, when the pinching fingers are forwardly rotated the opening becomes horizontally oriented such that a horizontal locking bar may be dropped through the opening. As the pinching fingers are backwardly rotated, the horizontal locking bar slides down into a locking pocket 107 formed by the rotation locking arm and the attachment bracket.

Figure 21:
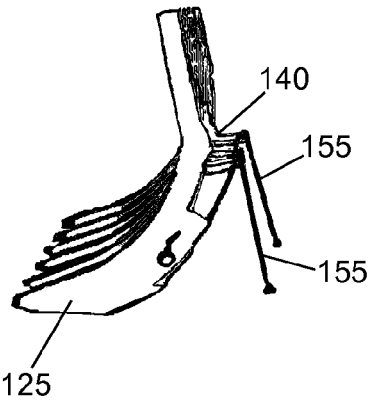
FIG. 21 is a side view of a detachable loader teeth supported in an orientation by moveable stands
Figure 22:
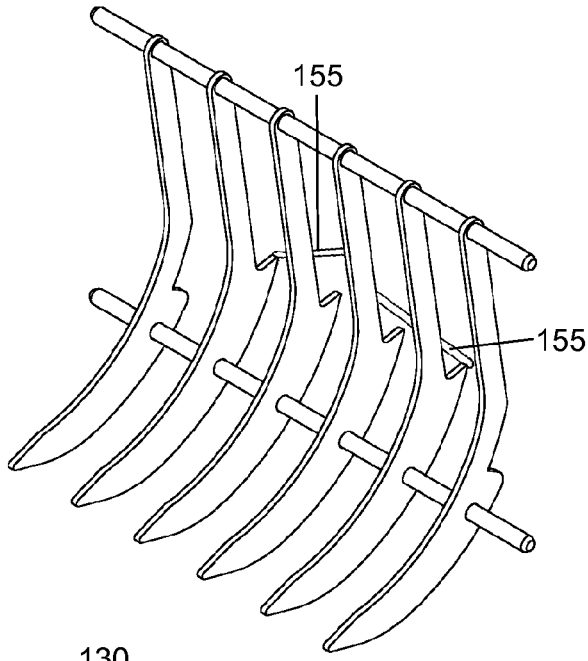
FIG. 22 is a perspective view of a detachable loader teeth having moveable stands oriented to secure the teeth to an attachment bracket.
Figure 23:
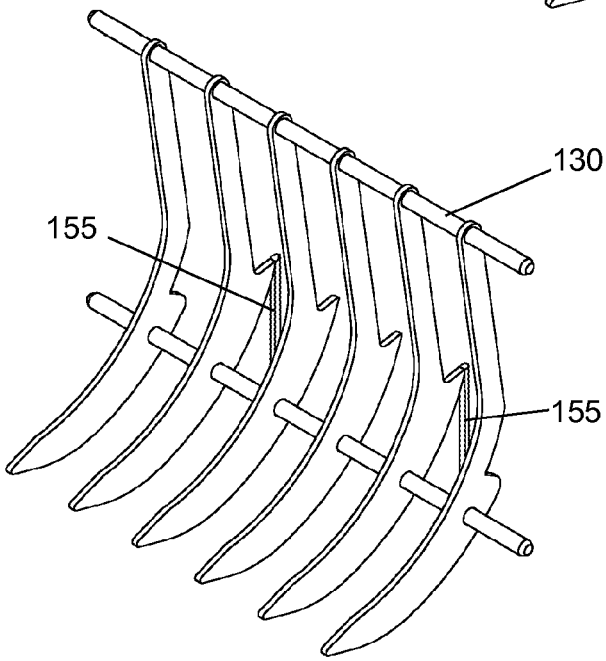
FIG. 23 is a perspective view of a detachable loader teeth having moveable stands oriented to facilitate attachment of a secondary implement onto an attachment bracket.

FIG. 21 shows a side view of a secondary implement with a plurality of teeth 125 wherein at least two of the corner sections of the plurality of teeth include implement stands 155. The implement stands 155 act to keep the secondary implement in an upright orientation to facilitate connection with an attachment bracket extending between two pinching fingers. When the implement stands 155 are in the orientation shown in FIG. 22, the implement stands 155 act to secure the secondary implement to the attachment bracket when the pinching fingers are rotated to a forward position. In an exemplary embodiment of the device, no additional tools are required to secure the secondary implement to the attachment bracket extending between the pinching fingers. FIG. 23 shows another perspective view of the implement stands 155 supporting the horizontal locking bar 130 of a secondary implement at an elevation sufficient to facilitate locking to an attachment bracket.

Figure 24:
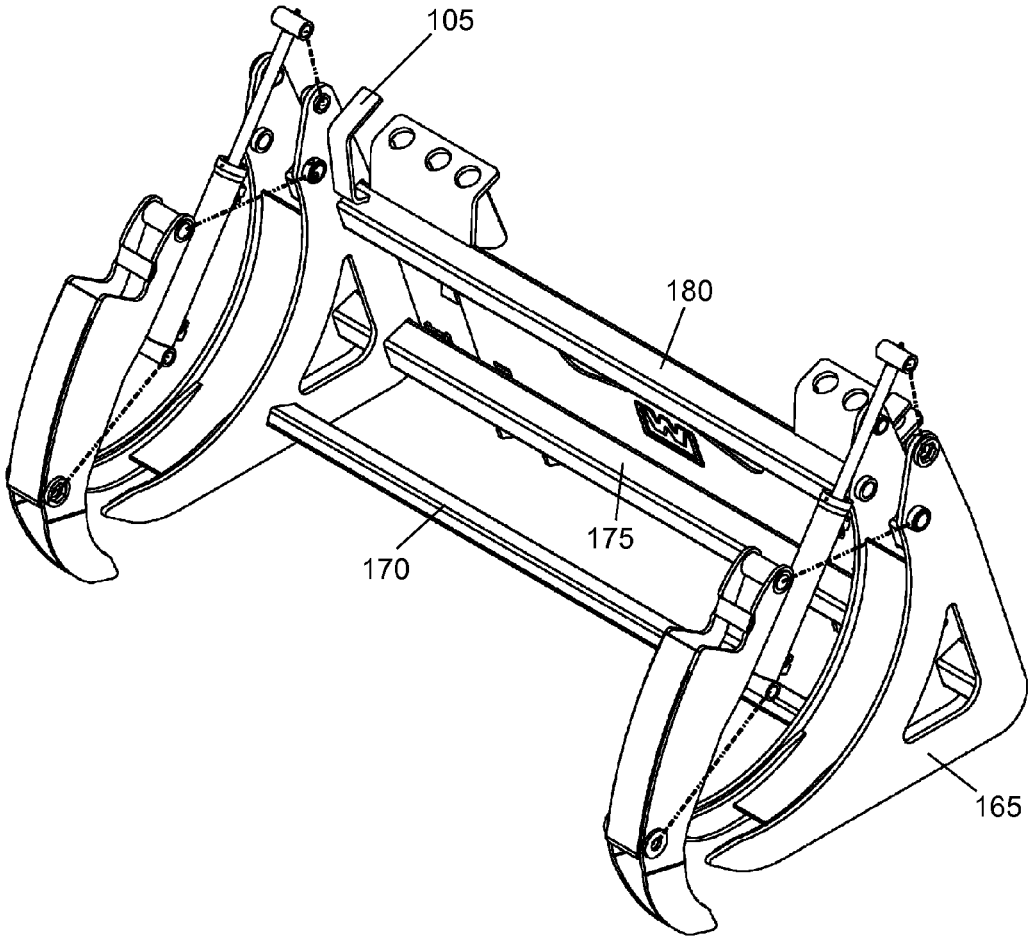
FIG. 24 is an exploded perspective view of a dual set of pinching fingers connected together by three stabilizer bars, wherein the stabilizer bars include attachment brackets for connection of an auxiliary implement between the pinching fingers. Each lower claw of the pinching fingers also includes an implement stand.

FIG. 24 illustrates a set of pinching fingers where each lower claw of the pinching fingers includes a support stand 165 that acts to maintain the pinching fingers in an operational orientation when the device is detached from a vehicle. By maintaining the device in an operational orientation, attachment to a vehicle or construction machinery is made easier. In addition to making attachment to a vehicle easier, the support stands 165 help to extend the life of the pinching fingers by reducing the amount of dirt and debris that the hinges of the pinching fingers are exposed to when the pinching fingers are not in use.

In addition to maintaining the pinching fingers in an operational orientation, the support stands 165 are useful during the operation of the pinching fingers. In one embodiment of the device the support stands are utilized to scrape and grate the ground in front of a vehicle. Alternatively, the support stands 165 may be utilized as a connection point for a secondary implement. In yet another embodiment of the device, connection holes extend horizontally across the support stands 165 to facilitate connection of secondary implements such as graters, plows, aerators, scrapers, mowers, and other devices below the support stands. Extending between the support stands 165 of the pinching fingers are a front stabilizer 170, a rear stabilizer 175, and an upper stabilizer 180. In addition to providing stability to the support stands and the pinching fingers, the front, rear, and upper stabilizers provide a location to attach a secondary implement between the pinching fingers. As seen in FIG. 24, a rotation locking arm 105 is secured to the upper stabilizer 180 so that a secondary implement may be attached to the device as previously described. The upper stabilizer 180 acts to support the secondary implement in a manner similar to the support tabs. Rotatable stands of a secondary implement may be rotated around the front stabilizer 170 to secure the secondary implement to the device.

Figure 25:
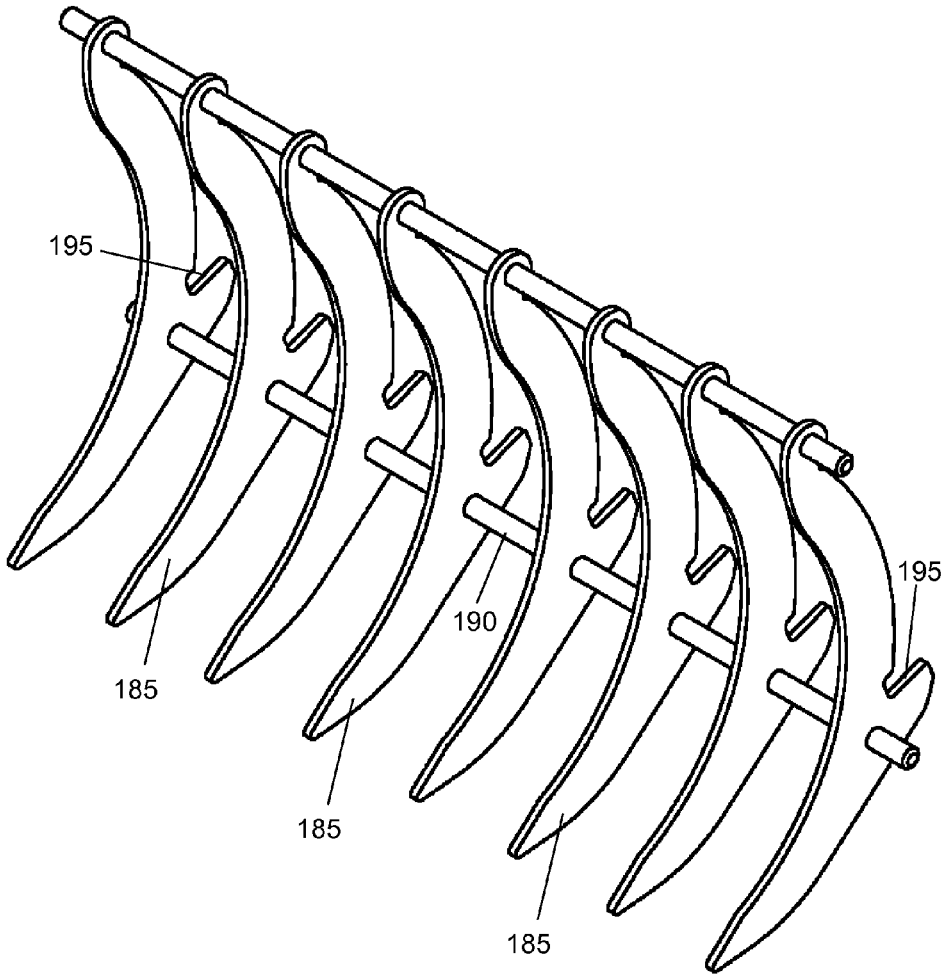
FIG. 25 is a perspective view of detachable implement teeth structured to connect to the attachments bracket of FIG. 24.

FIG. 25 illustrates an example of a secondary implement having a plurality of teeth 185 stabilized by a lateral bar 190 that extends through all of the plurality of teeth. Connected to all of the teeth is a horizontal locking bar 130 adapted to connect to the rotation locking arm and upper stabilizer of the device of FIG. 24. Each of the plurality of teeth 185 has a corner region 195 and is adapted to lock into a front stabilizer extending between the stands of two pinching fingers. The secondary implement of FIG. 25 may be secured to and removed from the device of a FIG. 24 in the manner described in regards to FIGS. 14 and 15. Rotatable stands may be connected to some of the corner regions 195 of the secondary implement to maintain the secondary implement in an operational orientation when the secondary implement is not connected to a vehicle. The rotatable stands may also be utilized to secure the secondary implement to the front stabilizer in the manner described in regards to FIGS. 21 through 23.

Figure 26:
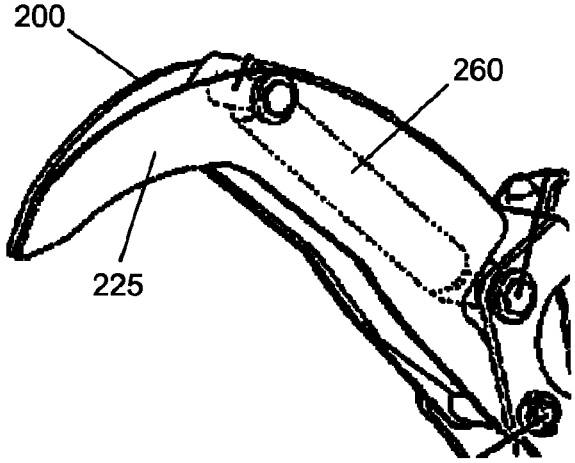
FIG. 26 shows a partial perspective view of pinching finger with a cross section of the top claw substantially enclosing a hydraulic cylinder.
Figure 27:
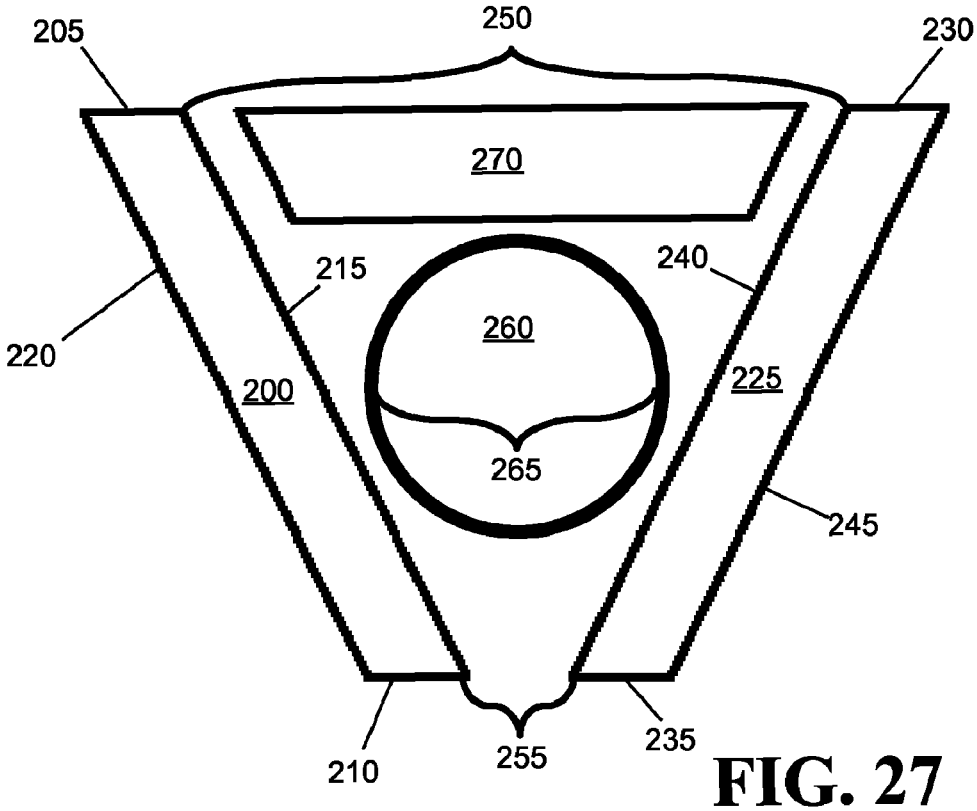
FIG. 27 shows a cross section of the pinching fingers of FIG. 26.

FIG. 26 shows an embodiment of a pinching finger with a first top pincer claw comprising a first claw plate 200, a second claw plate 225, and a hydraulic cylinder 260 with a cross section shown in FIG. 27. In the cross section, the first claw plate 200 has a first top surface 205, a first bottom surface 210, a substantially flat first interior surface 215 and a substantially flat exterior surface 220 extending between the first top surface and the first bottom surface 210. A second claw plate 225 has a second top surface 230, a second bottom surface 235, a substantially flat second interior surface 240 and a substantially flat exterior surface 245 extending between the second top surface and the second bottom surface 235. The first and second top surfaces of the claw plates are separated by a top distance 250 and the first and second bottom surfaces are separated by a bottom distance 255. In the illustrated example, the top distance 250 is substantially larger than the bottom distance 255. A hydraulic cylinder 260 for actuating the claw is located between the substantially flat first interior surface 215 and the second substantially flat interior surface 240. The hydraulic cylinder 260 has a diameter 265 that is longer than the bottom distance 255 and shorter than the top distance 250. A top claw plate 270 extends from the first surface 205 to the second top surface 230. The top claw plate 270, the first clop plate 200, and the second claw plate 225 cooperate to substantially enclose the hydraulic cylinder 260.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

We claim:

1. An implement for attachment to a utility vehicle having a boom, a lift cylinder for actuating the boom, and a coupler cylinder for rotating the implement, the implement comprising:

a first pinching finger including
- a first claw rotatably secured to a claw actuator at an actuator hinge,
- a second claw
  - rotatably secured to the first claw at a pincer hinge located a first distance from the actuator hinge;
  - rotatably secured to and enclosing the claw actuator, and
  - including a side claw plate both connecting to and rotatable about the pincer hinge, the side claw plate having a corner section located at substantially the first distance from the pincer hinge, the corner section having a shape substantially defined by the actuator hinge.

2. The implement of claim 1 further comprising:

the first claw including a left tine and a right tine, wherein a portion of the side claw plate is located between the right tine and the left tine when the first pinching finger is fully closed.

3. The implement of claim 1 further comprising:

a second pinching finger including a third claw rotatably secured to a fourth claw, a rotation locking arm rigidly secured between the first claw and the third claw, the rotation locking arm forming a locking pocket with an opening in a vertical orientation when the implement is backwardly rotated and a horizontal orientation when the implement is forwardly rotated.

4. The implement of claim 3 further comprising:
a secondary device attached to the rotation locking arm;
the secondary device having a horizontal locking bar securable in the locking pocket between the first and second pinching fingers.

5. A method of operating the implement of claim 3 comprising the steps of:
positioning the horizontal locking bar between the first and second pinching fingers;
forwardly rotating the implement to horizontally orient the opening of the locking pocket;
positioning the rotation arm below the horizontal locking bar;
scooping up the horizontal locking bar with the rotation locking arm; and
backwardly rotating the implement to seat the horizontal locking bar into the locking pocket.

6. The implement of claim 4 further comprising:
an attachment bracket extending from the first pinching finger to the second pinching finger; and
a stand secured to the secondary implement, the stand rotatable from a first configuration to a second configuration,
wherein in the first configuration the stand supports the weight of the secondary implement, and wherein in the second configuration a portion of the attachment bracket is located between the stand and the secondary implement.

7. A utility vehicle comprising:
a first arm, a second arm, and at least one hydraulic lift actuator for raising and lowering the arms relative to the utility vehicle;
a first grapple rotatably attached to the first arm;
a first hydraulic coupler actuator attached to the first arm and the first grapple so that the first grapple may be rotated forward and backward relative to the utility vehicle upon activation of the first hydraulic coupler actuator;
the first grapple including a first upper claw, a first lower claw, and a first hydraulic claw actuator connected to the first upper claw and the first lower claw, the first upper claw being rotatably attached to the first lower claw at a first hinge so that the first upper claw and the first lower claw may be opened and closed relative to one another upon activation of the first hydraulic claw actuator;
the first upper claw including
a first claw plate with a first top surface connected to
a first bottom surface via
a first exterior surface
a second claw plate with a second top surface connected to
a second bottom surface via
a second exterior surface;
the first upper claw having a first cross-section wherein
the first top surface is a first top distance from the second top surface,
the first bottom surface is a first bottom distance from the second bottom surface,
the first top distance is substantially greater than the first bottom distance, and
the first hydraulic claw actuator being located between the first exterior surface and the second exterior surface; and
a bracket connector extending from the first grapple across the width of the vehicle.

8. The vehicle of claim 7 further comprising:
a second grapple rotatably attached to the second arm;
a second hydraulic coupler actuator attached to both the second arm and the second grapple so that the second grapple may be rotated forward and backward relative to the utility vehicle upon activation of the second hydraulic coupler actuator;
the second grapple comprising a second upper claw, a second lower claw and a second hydraulic claw actuator connected to the second upper claw and the second lower claw, the second upper claw being rotatably attached to the second lower claw at a second hinge so that the second upper claw and the second lower claw may be opened and closed relative to one another upon activation of the second hydraulic claw actuator; and
the bracket connector extending from the first grapple to the second grapple.

9. The vehicle of claim 7 wherein
the first hydraulic claw actuator includes a cylinder having a diameter longer than the first bottom distance.

10. A utility vehicle comprising:
a first arm, a second arm, and at least one hydraulic lift actuator for raising and lowering the arms relative to the utility vehicle;
a first grapple rotatably attached to the first arm;
a first hydraulic coupler actuator attached to the first arm and the first grapple so that the first grapple may be rotated forward and backward relative to the utility vehicle upon activation of the first hydraulic coupler actuator;
the first grapple including a first upper claw, a first lower claw, and a first hydraulic claw actuator connected to the first upper claw and the first lower claw, the first upper claw being rotatably attached to the first lower claw at a first hinge so that the first upper claw and the first lower claw may be opened and closed relative to one another upon activation of the first hydraulic claw actuator;
the first upper claw including
a first claw plate having a substantially flat first interior surface,
a second claw plate having substantially flat second interior surface,
a portion of the substantially flat first interior surface connecting to a portion of the substantially flat second interior surface, and
the first hydraulic claw actuator substantially located between the substantially flat first interior surface and the substantially flat second interior surface; and
a bracket connector extending from the first grapple across the width of the vehicle.

11. A utility vehicle comprising:
a first arm, a second arm, and at least one hydraulic lift actuator for raising and lowering the arms relative to the utility vehicle;
a first grapple rotatably attached to the first arm;
a first hydraulic coupler actuator attached to the first arm and the first grapple so that the first grapple may be rotated forward and backward relative to the utility vehicle upon activation of the first hydraulic coupler actuator;
the first grapple including a first upper claw, a first lower claw, and a first hydraulic claw actuator connected to the first upper claw and the first lower claw, the first upper claw being rotatably attached to the first lower claw at a first hinge so that the first upper claw and the first lower claw may be opened and closed relative to one another upon activation of the first hydraulic claw actuator;
the first upper claw including a first claw plate with a flat first interior surface connecting to the first hydraulic claw actuator, and a second claw plate with a flat second interior surface connecting to the first hydraulic claw actuator wherein a portion of first interior surface directly connects to a portion of the second interior surface, and the first hydraulic claw actuator is substantially located between the first interior surface and the second interior surface;

the first lower claw including a left tine and a right tine, wherein a portion of the first claw plate is located between the right tine and the left tine when the first grapple is in a fully closed orientation.

12. A utility vehicle comprising:

a first arm, a second arm, and at least one hydraulic lift actuator for raising and lowering the arms relative to the utility vehicle;

a first grapple rotatably attached to the first arm;

a first hydraulic coupler actuator attached to the first arm and the first grapple so that the first grapple may be rotated forward and backward relative to the utility vehicle upon activation of the first hydraulic coupler actuator;

the first grapple including a first upper claw, a first lower claw, and a first hydraulic claw actuator connected to the first upper claw and the first lower claw, the first upper claw being rotatably attached to the first lower claw at a first hinge so that the first upper claw and the first lower claw may be opened and closed relative to one another upon activation of the first hydraulic claw actuator;

a bracket connector extending from the first grapple across the width of the vehicle;

a locking scoop connecting to the bracket connector;

the locking scoop forming a pocket with the bracket connector; and a set of detachable teeth having both a bar secured in the pocket and a stand.

13. A method of operating the vehicle of claim 12 extending the first hydraulic coupler actuator to forwardly rotate the first lower claw; scooping up the bar with the locking scoop; and retracting the first hydraulic coupler actuator to backwardly rotate the first lower claw to lower the horizontal bar into the pocket.

14. An implement for attachment to a utility vehicle having a boom, a lift cylinder for actuating the boom, and a coupler cylinder for rotating the implement, the implement comprising:

a pinching finger including a first claw rotatably secured to a claw actuator, a second claw having an upper claw plate located above the claw actuator, rotably secured to and enclosing the claw actuator, and rotatably secured to the first claw;

the claw actuator including a rod extending from a hydraulic chamber, the rod moveable from a retracted state, through an intermediate state, to an extended state, in both the extended state and the retracted state the rod located distant from the upper claw plate, and in the intermediate state, the rod located proximal to the upper claw plate.

15. The implement of claim 14 further comprising:

the first claw rotatably secured to the claw actuator at an actuator hinge, the second claw rotatably secured to the first claw at a pincer hinge located a first distance from the actuator hinge, and including a lateral claw plate both connecting to and rotatable about the pincer hinge, the lateral claw plate having a corner section located at substantially the first distance from the pincer hinge, the corner section having a shape substantially defined by the actuator hinge.

16. The implement of claim 15 further comprising:

the first claw including a left tine and a right tine, wherein a portion of the lateral claw plate is located between the right tine and the left tine when rod is in the extended state.

17. The implement of claim 14 further comprising:

a fastening scoop secured to the first claw for securing a detachable secondary device to the implement, the fastening scoop forming a locking pocket with the implement.

18. A method of operating the implement of claim 17 comprising, rotating the implement forward to horizontally orient an opening of the locking pocket;

positioning the fastening scoop below a locking bar of the detachable secondary device;

scooping up the locking bar with the fastening scoop; and rotating the implement backward to lower the locking bar into the locking pocket.

19. The method of claim 18 further comprising:

rotating a stand secured to the detachable secondary device to a first configuration, wherein in the first configuration a portion of an attachment bracket extending from the first claw is located between the stand and the detachable secondary device.

* * * * *